US008616020B1

(12) United States Patent
Abraham, III

(10) Patent No.: US 8,616,020 B1
(45) Date of Patent: Dec. 31, 2013

(54) MULTI-CONFIGURABLE FROSTED BAR RAIL SYSTEM

(76) Inventor: Martin J. Abraham, III, Bogalusa, LA (US)

( * ) Notice: Subject to any disclaimer, the term of this patent is extended or adjusted under 35 U.S.C. 154(b) by 950 days.

(21) Appl. No.: 12/590,037

(22) Filed: Oct. 30, 2009

Related U.S. Application Data

(60) Provisional application No. 61/217,524, filed on Jun. 1, 2009, provisional application No. 61/269,607, filed on Jun. 26, 2009.

(51) Int. Cl.
*F25D 3/00* (2006.01)

(52) U.S. Cl.
USPC ..... 62/393

(58) Field of Classification Search
USPC ..... 62/389, 150.66, 393, 390, 150, 66
See application file for complete search history.

(56) References Cited

U.S. PATENT DOCUMENTS

| | | | | | |
|---|---|---|---|---|---|
| 2,414,446 | A | * | 1/1947 | Carbone | 40/332 |
| 2,515,367 | A | | 7/1950 | Booker | |
| 3,598,287 | A | | 8/1971 | de Man | |
| 4,189,928 | A | | 2/1980 | Cerny | |
| 4,306,616 | A | | 12/1981 | Woods et al. | |
| 4,350,267 | A | * | 9/1982 | Nelson et al. | 222/131 |
| 4,351,157 | A | | 9/1982 | Zeigler | |
| 4,667,481 | A | | 5/1987 | Watanabe et al. | |
| 4,920,763 | A | | 5/1990 | Provest et al. | |
| 5,018,360 | A | | 5/1991 | Jones | |
| 5,456,387 | A | | 10/1995 | Trewhella | |
| 5,694,787 | A | * | 12/1997 | Cleleand et al. | 62/396 |
| 5,890,629 | A | * | 4/1999 | Loew | 222/144.5 |
| 5,921,096 | A | * | 7/1999 | Warren | 62/185 |
| 5,970,734 | A | | 10/1999 | Stillwell et al. | |
| 6,327,864 | B1 | | 12/2001 | Crowe | |
| 6,351,963 | B2 | | 3/2002 | Surber et al. | |
| 6,363,733 | B1 | | 4/2002 | Galembeck | |
| 6,381,968 | B1 | | 5/2002 | O'Donoghue, Jr. et al. | |
| 6,427,468 | B1 | | 8/2002 | Topper et al. | |
| 6,460,375 | B1 | * | 10/2002 | Lundaas | 65/29.19 |
| 6,487,873 | B2 | * | 12/2002 | Kyees | 62/390 |
| 7,272,935 | B1 | * | 9/2007 | Wolf et al. | 62/1 |
| 7,275,376 | B2 | * | 10/2007 | Swofford et al. | 62/81 |
| 8,347,646 | B1 | | 1/2013 | Abraham | |

(Continued)

OTHER PUBLICATIONS

Office Action Summary dated Jun. 7, 2013 for U.S. Appl. No. 12/798,263.

(Continued)

*Primary Examiner* — Cheryl J Tyler
*Assistant Examiner* — David Teitelbaum
(74) *Attorney, Agent, or Firm* — Raymond G. Areaux; Ian C. Barras; Carver, Darden, Koretzky, Tessier, Finn, Blossman & Areaux, LLC

(57) ABSTRACT

In accordance with an exemplary embodiment, the present invention includes a multi-configurable frosted bar rail system. The multi-configurable frosted bar rail system comprises a chilling and frost system having a compressor and refrigerant and a plurality of modular rail sections configured to be coupled together in series and to the chilling and frost system. Each rail section comprises a base pan configured to catch and drain defrosting ice and fluids; a top rail plate supported within the base pan; and a rail freezing and chilling mechanism coupled immediately under the top rail plate. The freezing and chilling mechanism is configured to create a continuous layer of frost on top of the top rail plate.

20 Claims, 26 Drawing Sheets

(56) References Cited

U.S. PATENT DOCUMENTS

| | | | | |
|---|---|---|---|---|
| 2005/0082510 | A1 | 4/2005 | Ponder et al. | |
| 2006/0272348 | A1* | 12/2006 | Kyees et al. | 62/390 |
| 2007/0144196 | A1* | 6/2007 | Currie | 62/264 |
| 2008/0092578 | A1 | 4/2008 | Yeagy | |
| 2008/0098762 | A1 | 5/2008 | Kent | |
| 2008/0178607 | A1* | 7/2008 | Schneller et al. | 62/3.64 |

OTHER PUBLICATIONS

Notice of Allowability for U.S. Appl. No. 12/590,038.

* cited by examiner

MULTI-CONFIGURABLE FROSTED BAR RAIL SYSTEM

COPENDING APPLICATIONS

This application also claim priority benefit of Provisional Patent Application No. 61/217,524, filed Jun. 1, 2009, titled "FROSTED BEVERAGE CHILLING AND DISPENSING DEVICE AND SYSTEM" having the same inventor of the instant patent application and which is incorporated herein by reference as if set forth in full below. This application claims priority benefit of Provisional Patent Application No. 61/269,607 filed Jun. 26, 2009, titled "Multi-Configurable Frosted Bar Rail System" having the same inventor of the instant patent application and which is incorporated herein by reference as if set forth in full below.

NOTICE OF COPYRIGHT PROTECTION

A portion of the disclosure of this patent document and its figures contain material subject to copyright protection. The copyright owner has no objection to the facsimile reproduction by anyone of the patent document or the patent disclosure, but otherwise reserves all copyrights whatsoever.

BACKGROUND

I. Field

The invention relates to a bar rail system configured to create a layer of frosty ice or snowy ice over a sheet of metal using humidity in the air.

II. Background

In New York and other metropolitan areas, there are many clubs, restaurants and bar establishments in close vicinity that compete for patrons, some of which simply walk by the storefront. Therefore, these businesses need a competitive edge. Thus, there is a need for restaurant, club and bar owners to provide accents, displays and other aesthetics which are trendy and attractive to catch a patron(s) interest.

A further challenge with accents, displays or other aesthetics is marrying such devices with usefulness as real estate is at a premium. For example, when displaying liquor bottles on the bar generally such bottles or the contents therein are not also chilled in a manner which is aesthetically trendy and attractive. Such devices should also not encumber the employees when performing their job.

SUMMARY

The aforementioned problems, and other problems, are reduced, according to exemplary embodiments, by the multi-configurable frosted bar rail system described herein.

According to an exemplary embodiment of the present invention, a rail section is provided. The rail section comprises a base pan configured to catch and drain defrosting ice and fluids. The rail section includes a top rail plate supported within the base pan; and a rail freezing and chilling mechanism coupled immediately under the top rail plate. The freezing and chilling mechanism is configured to create a continuous layer of frost on top of the top rail plate from humidity of ambient air The rail section according to the present invention includes a plurality of domes mounted to the top rail plate; and a plurality of dome lights arranged around a base of each dome. The plurality of dome lights are configured to illuminate a layer of frost on the domes and the top rail plate.

The rail section according the present invention further comprises a beer dispensing tower coupled to said top rail plate. The beer dispensing tower comprises a tower body wherein the tower body is configured to form a layer of frost on the tower body.

The rail section according to the present invention includes a top rail plate which is made of a metal having a first thermal conductivity factor. The rail freezing and chilling mechanism includes: a first non-metallic thermal layer immediately below the top rail plate; a metal thermal conductor layer made of a metal with a second thermal conductivity factor greater than the first conductivity factor below the first non-metallic thermal layer; a second non-metallic thermal layer below the metal thermal conductor layer; and at least one refrigerant line partially or fully embedded within the second non-metallic thermal layer, the at least one refrigerant line being configured to flow therethrough a refrigerant.

The rail section according to the present invention may include a dome comprising: an external dome plate having a top opening; an interior storage tank within the external dome plate; and a dome freezing and chilling mechanism between the external dome plate and the interior storage tank. The dome freezing and chilling mechanism being configured receive a refrigerant to build a layer of frost on along the external dome plate from humidity of ambient air. The dome being configured to seat in the top opening a bottle in an inverted position and to chill and dispense the beverage from the interior storage tank.

The rail section according to the present invention comprises a section connector tab coupled to a short side of the rail freezing and chilling mechanism, wherein the section connector tab is configured to be friction fit coupled to an adjacent rail section.

The rail section according to the present invention may include first and second elongated heating wires enclosed along longitudinal sides of the top rail plate; and a temperature control unit configured to control heat along each of the elongated heating wires to minimize condensation.

In accordance with another exemplary embodiment, the present invention includes a multi-configurable frosted bar rail system. The multi-configurable frosted bar rail system comprises a chilling and frost system having a compressor and refrigerant and a plurality of modular rail sections configured to be coupled together in series and to the chilling and frost system. Each rail section comprises a base pan configured to catch and drain defrosting ice and fluids; a top rail plate supported within the base pan; and a rail freezing and chilling mechanism coupled immediately under the top rail plate. The freezing and chilling mechanism being configured to create a continuous layer of frost on top of the top rail plate from humidity of ambient air.

Other systems, methods, and/or products according to embodiments will be or become apparent to one with skill in the art upon review of the following drawings, and further description. It is intended that all such additional systems, methods, and/or products be included within this description, be within the scope of the present invention, and be protected by the accompanying claims.

BRIEF DESCRIPTION OF THE DRAWINGS

The above and other exemplary embodiments, objects, uses, advantages, and novel features are more clearly understood by reference to the following description taken in connection with the accompanying figures wherein.

DESCRIPTION

Figure 1:
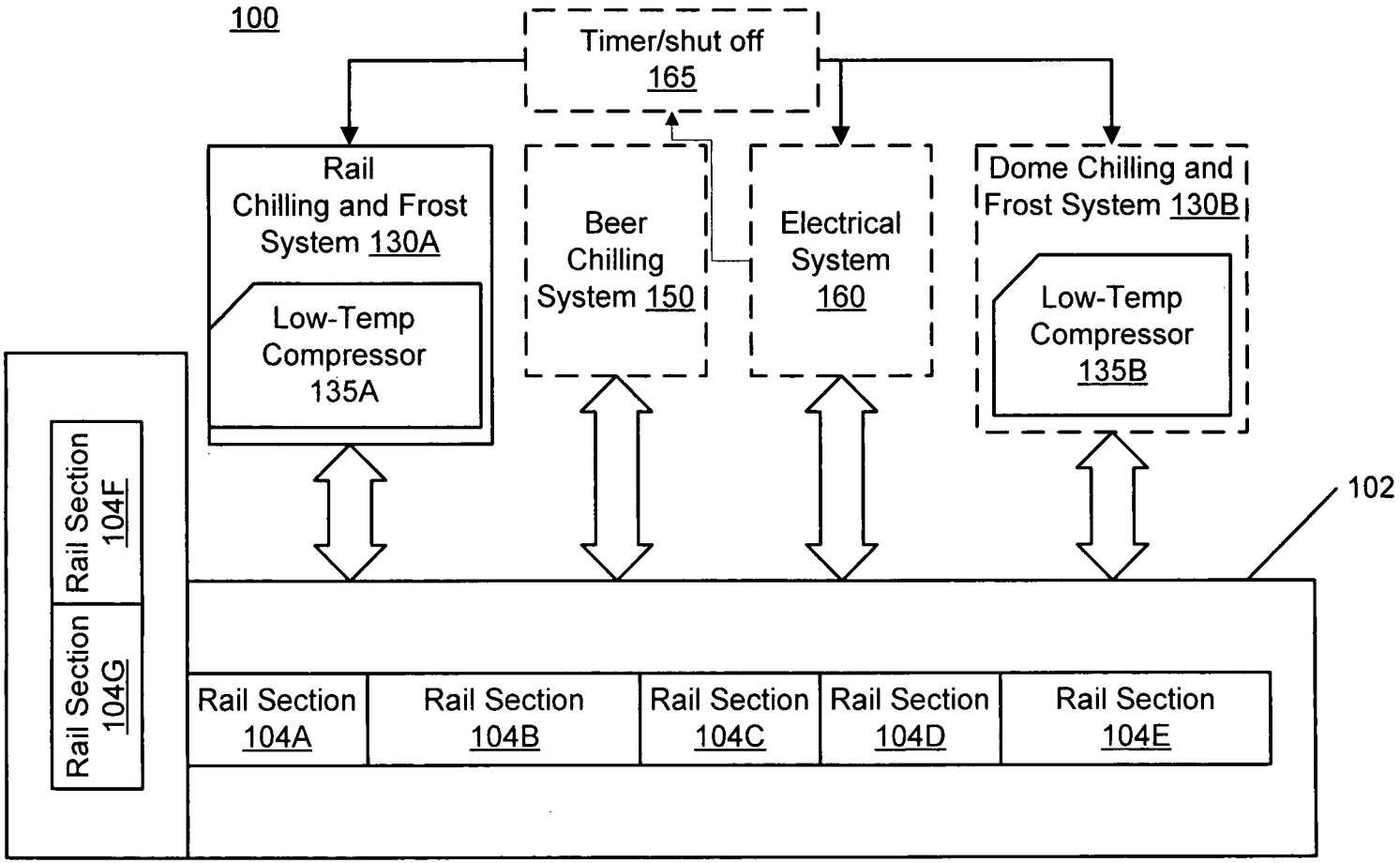
FIG. 1 illustrates a schematic view of a multi-configurable frosted bar rail system in accordance with some of the exemplary embodiments.

The word "exemplary" is used herein to mean "serving as an example, instance, or illustration." Any configuration or design described herein as "exemplary" is not necessarily to be construed as preferred or advantageous over other configurations or designs.

Within the descriptions of the figures, similar elements are provided similar names and reference numerals as those of the previous figure(s). Where a later figure utilizes the same element or a similar element in a different context or with different functionality, the element is provided a different leading numeral representative of the figure number (e.g., 1xx for FIG. 1 and 2xx for FIG. 2). The specific numerals assigned to the elements are provided solely to aid in the description and not meant to imply any limitations (structural or functional) on the invention.

This invention now will be described more fully hereinafter with reference to the accompanying drawings, in which exemplary embodiments are shown. This invention may, however, be embodied in many different forms and should not be construed as limited to the embodiments set forth herein. Moreover, all statements herein reciting embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Thus, for example, it will be appreciated by those of ordinary skill in the art that the diagrams, schematics, illustrations, and the like represent conceptual views or perspective views illustrating some of the frosted bar rail and modular rail sections of this invention. The functions of the various elements shown in the figures may vary in shape, attachment, size, and other physical features. Those of ordinary skill in the art further understand that the exemplary systems, and/or methods described herein are for illustrative purposes and, thus, are not intended to be limited to any particular named manufacturer or other relevant physical limitation (e.g., material).

The multi-configurable frosted bar rail system in accordance with the present invention includes a plurality of modular rail sections configured to be quickly affixed or coupled together and leveled with an end tab or section connector tab. The plurality of modular rail sections may include one or more of 1) a rail section configured to generate a layer of frosted snowy ice on top of a top rail plate without any accessories; 2) one or more frosted beverage chilling and dispensing rail sections (domes); 3) a rail section with lights; 4) a frosted beer tower rail section; 5) a beer tower rail section (without frosting of the beer tower); 6) one or more combination rail sections with at least one beer tower, one or more domes and with or without lights. Any one of the rail sections may be provided with lights.

When using one or more frosted beverage chilling and dispensing rail sections (domes) in the multi-configurable frosted bar rail system, the system comprises a remote dome chilling and frost system coupled to a frosted beverage chilling and dispensing rail section. The frosted beverage chilling and dispensing rail section includes a frosted dome mounting rail with one or more frosted beverage chilling and dispensing domes configured to chill beverages within the dome, the dome being configured to create snowy white frosted ice or frost evenly around and about its exterior perimeter wall surface.

In an exemplary embodiment, a combination frosted rail section include a frosted beverage chilling and dispensing rail section with a frosted or non-frosted beer dispensing tower.

The frosted beverage chilling and dispensing rail section in accordance with one embodiment comprises at least one frosted beverage chilling and dispensing dome configured to chill liquor to a temperature within a predetermined range of cold temperatures.

The frosted beverage chilling and dispensing rail section is configured to dispense liquor from a vertically seated liquor bottle.

The frosted beverage chilling and dispensing rail section is configured to chill in and dispense liquor from a dome in the range of −5° to +5°.

In an exemplary embodiment, the frosted beverage chilling and dispensing rail section is a liquor beverage chiller and dispensing rail section that builds a layer of frost (snowy white frost) on an exterior perimeter surface of a dome and chills an interior liner of the dome to a temperature to chill the liquor beverage stored therein. The liquor is stored in direct contact with the interior liner. A top rail plate of the frosted beverage chilling and dispensing rail section is also configured to form a layer of frost (snowy white frost or ice) on top of the top rail plate.

In an exemplary embodiment, the frosted beverage chilling and dispensing dome has a cylindrical shape with a top mounted seat (centrally located) configured to seat a liquor bottle vertically upside down. Thus, liquor is dispensed from a vertically upside down bottle under gravity into the cavity of the interior liner. As the liquor is dispensed, the liquor remaining in the bottle is replaced in the cavity of the interior liner of the dome.

In an exemplary embodiment, the frosted beverage chilling and dispensing rail section comprises a means for illuminating the dome, the frost on the frosted beverage chilling and dispensing dome and/or the frost of the frosted beverage chilling and dispensing rail section.

In an exemplary embodiment, the frosted beverage chilling and dispensing dome comprises a cylindrically-shaped structure. Nonetheless, other geometric shaped structures can be used for the frosted beverage chilling and dispensing dome.

In an exemplary embodiment, the frosted beverage chilling and dispensing dome is configured to form white snowy like frost on the exterior perimeter surface in ambient or room temperatures associated with a dining room, bar or main lounge environment.

In an exemplary embodiment, the frosted beverage chilling and dispensing dome comprises a metal plate forming the dome with a central aperture or top opening in a top surface to seat a liquor bottle. The exterior surface of the metal plate forms frosted ice evenly and continuously thereon such that there are no gaps, strips or other discontinuities of ice or frost formations.

FIG. 1 illustrates a schematic view of a multi-configurable frosted bar rail system 100 in accordance with some of the exemplary embodiments. The system 100 includes a plurality of modular rail sections, denoted as rail sections 104A-104G. The plurality of modular rail sections 104A-104G are configured to be mounted to a bar structure 102. Each rail section 104A-104G is configured to be friction fit coupled or coupled using a quick connection so that the rail sections 104A-104G are easily butted up against each other to form a continuous length of each rail section 104A-104G. The rail sections 104A-104G are configured to form frost or snowy white ice thereon and along the length of the rail section in a continuous manner. In other words, the ice or frost is formed so that patches are not generally formed. Instead, a sheet of frost is created using the humidity in the air.

Each rail section 104A-104G may include a variety of designs to complete the multi-configurable frost rail system. In a restaurant, depending on the food, one or more rail sections may be series coupled (friction fit) to create a continuous strip of frost or snowy ice. In a restaurant portion of an establishment, the accessories directed to dispensing chilled beverages would not be required. The configuration may incorporate lights. Likewise, the bar section of an establishment may include a plurality of rail sections series coupled (friction fit) to create a continuous strip of frost or snowy ice.

The multi-configurable frost rail system 100 is designed to incorporate one or more rail sections 104A-104G with beverage dispensing accessories and/or means for illuminating the accessories or the rail section itself. Thus, multi-configurable frost rail system 100 may incorporate or substitute one or more non-accessorized rail sections with a frosted beverage chilling and dispensing rail section (FIG. 16), combination rail section (FIG. 2A-2D), or a frosted (or non-frosted) beer tower rail section (FIG. 3).

If lighting is included and/or to power a low-temp compressor, the multi-configurable frost rail system 100 includes an electrical system or electrical system hookup 160. The multi-configurable frost bar rail system 100 includes a rail chilling and frost system 130A to deliver the coolant or refrigerant to the rail sections 104A-104G. The multi-configurable frost bar rail system 100 may also include a beer chilling system 150 to deliver chilled beer and/or to generate frost on the beer tower, and/or a dome chilling and frost system 130B when the accessory includes domes.

A timer or shutoff 165 is included so that the system 100 may be defrosted over night. The system 100 may be designed to automatically turn off or on. The system 100 may be left on for a predetermined period of time which may be hours, days, or weeks. The longer the time of operation without defrosting the system, the taller the growth of the frost (depending on the humidity in the air).

Figure 2A:
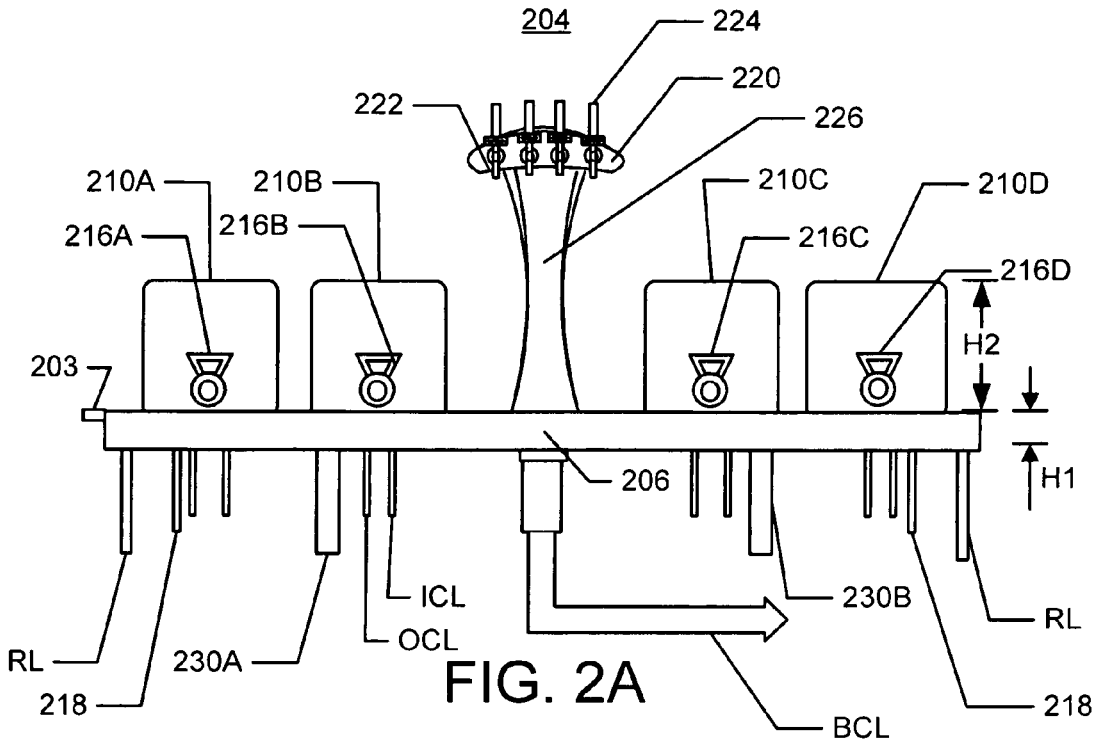
FIG. 2A illustrates a front schematic view of a frosted beverage chilling and dispensing rail section (without lights) for use in the system of FIG. 1 in accordance with some of the exemplary embodiments.
Figure 2B:
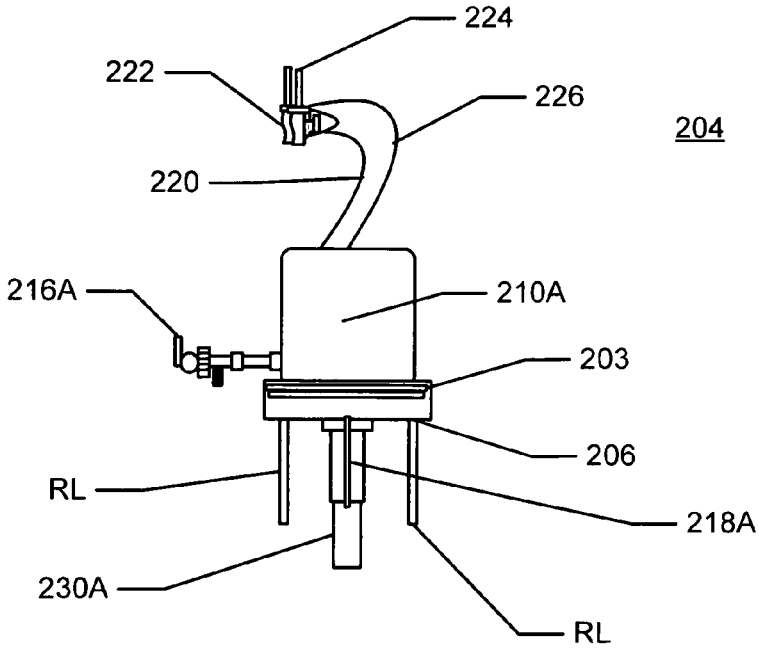
FIG. 2B illustrates a side schematic view of the frosted beverage chilling and dispensing rail section (without lights) in accordance with the embodiment of FIG. 2A.
Figure 2C:
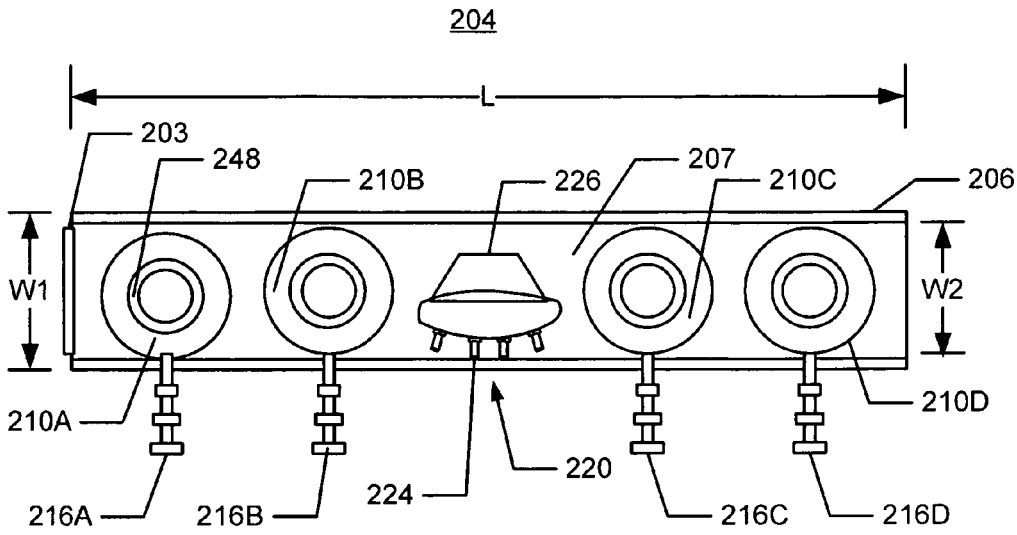
FIG. 2C illustrates a top schematic view of the frosted beverage chilling and dispensing rail section in accordance with the embodiment of FIG. 2A.
Figure 3:
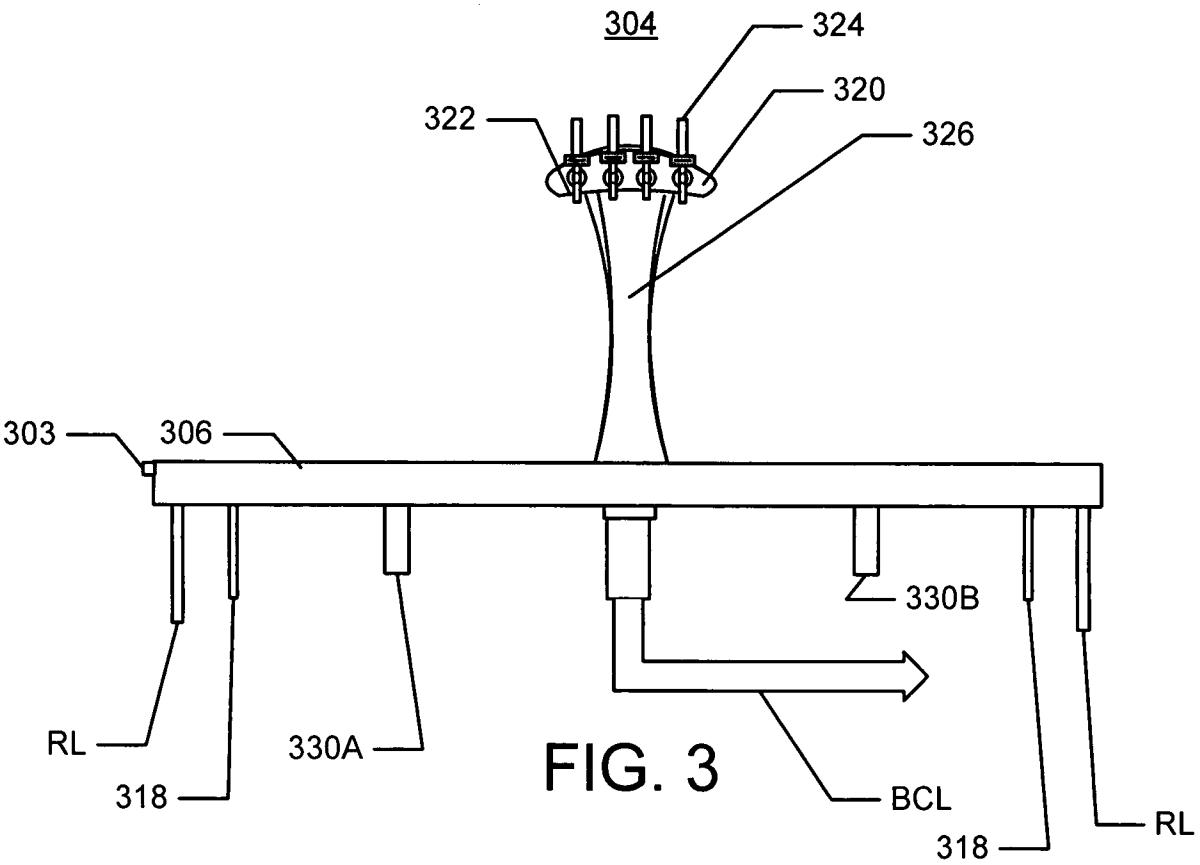
FIG. 3 illustrates a front schematic view of a frosted beer tower rail section for use in the system of FIG. 1 in accordance with some of the exemplary embodiments.

FIGS. 2A-2C illustrates front, side and top schematic views of a frosted beverage chilling and dispensing rail section 204 (without lights) in accordance with some of the exemplary embodiments. The frosted beverage chilling and dispensing rail section 204 is shown with a frosted dome mounting rail 206. The frosted dome mounting rail 206 has a plurality of frosted beverage chilling and dispensing domes 210A, 210B, 210C and 210D mounted thereto and a frosted beer dispensing tower 220.

The frosted dome mounting rail 206 has mounted thereto four frosted beverage chilling and dispensing domes 210A, 210B, 210C and 210D. However, the frosted dome mounting rail 206 may have more or less domes mounted thereto. The length of the rail section would determine the number of domes. In an embodiment, four domes 210A, 210B, 210C and 210D with a centrally positioned frosted beer dispensing tower 220 are provided with two domes on each side of the tower 220.

In an embodiment, the frosted beer dispensing tower 220 may be replaced with a fifth dome mounted to the frosted dome mounting rail 206. Nonetheless, the frosted dome mounting rail 206 may be configured to support one or more domes 210A, 210B, 210C and 210D with one or more beverage dispensing towers 220 that may dispense beer or other chilled beverages.

The rail section 204 includes, on one of the short sides, a section connector tab 203 to friction fit coupled to the next or adjacent rail section (e.g., rail sections 104A-104G). The opposite side of the rail section 204 is configured to have the section connector tab 203 of an adjacent rail section friction fit coupled under the top rail plate 207, as will be described in more detail. The section connector tab 203 is configured to level the top rail plate 207 of a rail section with the top rail plate 207 of an adjacent rail sections.

In an embodiment, the frosted beer dispensing tower 220 is configured to dispense therefrom beer at 32° F. However, the beer may be dispensed in the range of 27°-32°. The tower 220 has a plurality of dispensing heads 222 with levers 224. Each lever 224 or dispensing head 222 is configured to or is connected to a respective one beer or beverage line to dispense a single beverage product.

The domes 210A, 210B, 210C and 210D are configured to dispense a liquor beverage in the range of −5° to +5° for extremely cold temperatures. However, the liquor may be dispensed at other temperatures below −5° or above +5°. Each dome 210A, 210B, 210C and 210D includes a port 658 (FIG. 6A) having coupled thereto a dispensing faucet 216A, 216B, 216C and 216D, respectively. The faucets may have a 3⅝ or 5⅜ inch length.

As best seen in FIG. 2C, the frosted dome mounting rail 206 has a length L of approximately 48 inches and a width W1 of approximately 9¼ inches. A top rail plate 207 has a width W2 of approximately 8 inches on which frost or snowy white frosted ice is formed. The frosted dome mounting rail 206 also has a height H1 (FIG. 2A) of approximately 2 inches. The dome has a height H2 (FIG. 2B) of approximately 7⅜ inches measured from the top of the frosted dome mounting rail 206 to the top of the dome. The dimensions herein are illustrative and may vary. For example, the frosted dome mounting rail 206 may have a length L of 60 inches or other shorter or longer lengths.

Each frosted beverage chilling and dispensing dome 210A, 210B, 210C and 210D has an incoming coolant line ICL and an outgoing coolant line OCL journalled through the frosted dome mounting rail 206 and into the interior of the frosted beverage chilling and dispensing dome. In an exemplary embodiment, the coolant lines ICL and OCL enter in front of the dome 210A, 210B, 210C, and 210C in proximity to a port 658 (FIG. 6A) for the dispensing faucet 216A, 216B, 216C and 216D, respectively.

Figure 5:
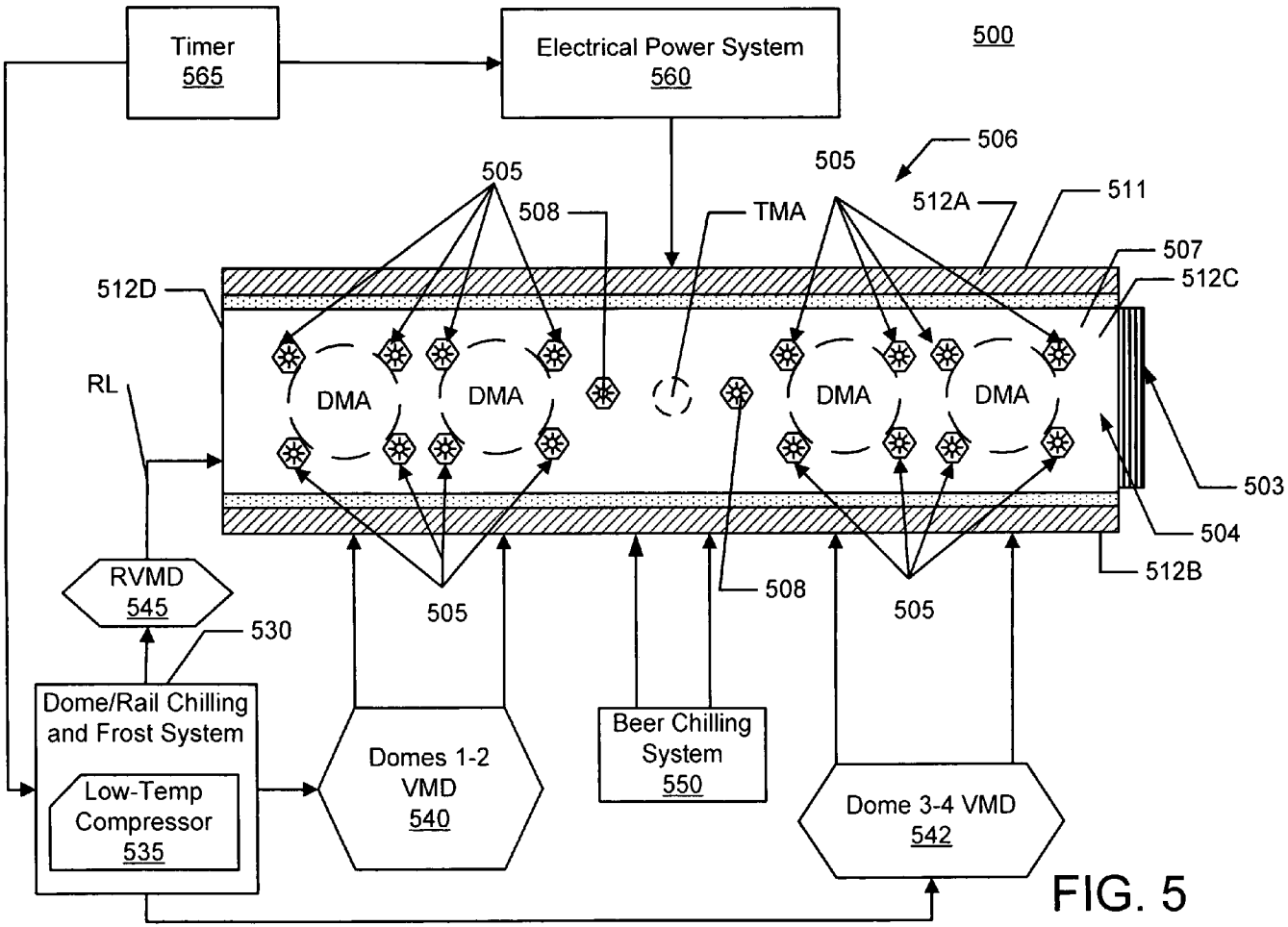
FIG. 5 illustrates a schematic view of a multi-configurable frosted bar rail system with a frosted beverage chilling and dispensing rail section with lights for in accordance with some of the exemplary embodiments.

The frosted dome mounting rail 206 is mounted to a bar structure via studs 218. The frosted dome mounting rail 206 receives the coolant lines ICL and OCL from a remote dome chilling and frost system 130B, as best seen in FIG. 1. Coolant line ICL and OCL receive and return refrigerant or coolant for the domes. The rail chilling and frost system 130A of FIG. 1 receives a refrigerant or coolant at the rail 206 on line RL and returns the refrigerant or coolant on line RL. The frosted dome mounting rail 206 includes one or more drains 230A, 230B to capture and channel water or fluid of defrosting ice away from and out of the frosted dome mounting rail 206. The frosted dome mounting rail 206 captures the water or fluid created by defrosting ice or frost on the domes via a freeze break FB (FIG. 5).

The center of the frosted dome mounting rail 206 has mounted thereto the frozen beer dispensing tower 220. However, other beverages may be dispensed from the tower 220. The frozen beer dispensing tower 220 has a tower body 226, made of metal such as stainless steel. While yellow metals may be used, stainless steel may be preferred. The stainless steel tower body 226 has a hollow interior configured to be flooded (filled) with the coolant or refrigerant in the beer lines BCL used to chill the beer or other beverage sent to the tower 220 to be dispensed. The coolant or refrigerant in the beer lines BCL is then returned to the beer chilling system 550 (FIG. 5) via return lines of the beer lines BCL.

Generally, lines carrying beer or other beverages are communicated to the dispensing tower 220 in parallel with coolant or refrigerant lines used to chill or keep chilled the beer or beverage. The coolant and refrigerant may be returned via return lines to the remote beer chilling system 550 (FIG. 5). However, the frozen beer dispensing tower 220 is flooded with the coolant and refrigerant to chill and frost the exterior surface of the tower 220. The dispensing tower 220 is configured to create frost along the perimeter surface.

Figure 2D:
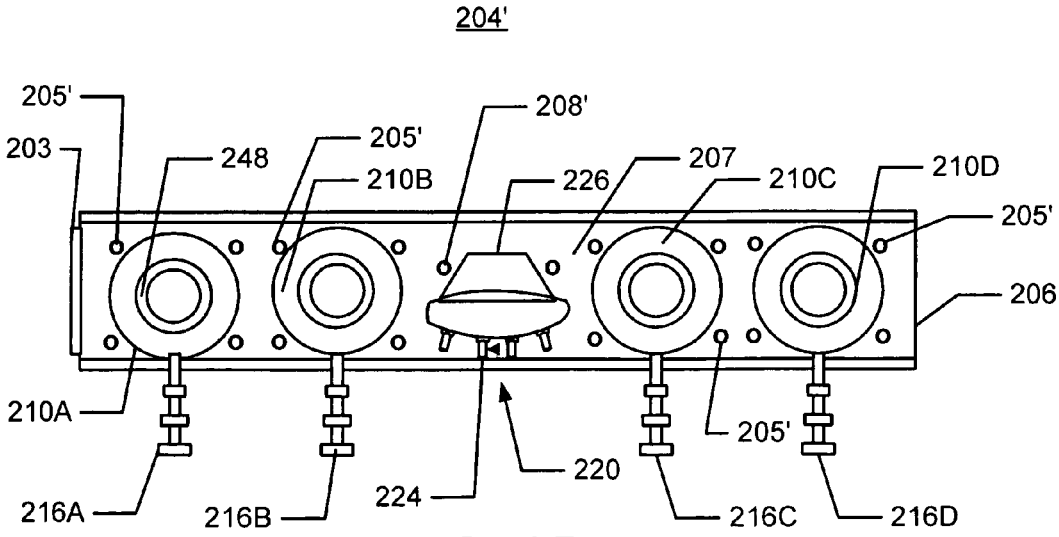
FIG. 2D illustrates a top schematic view of the frosted beverage chilling and dispensing rail section with lights in accordance with some exemplary embodiments.

FIG. 2D illustrates a top schematic view of the frosted beverage chilling and dispensing rail section 204' (with lights) in accordance with some exemplary embodiments. The frosted beverage chilling and dispensing rail section 204' is essentially the same as rail section 204 of FIGS. 2A-2C except that the rail section 204' has lights 205' and 208'. The lights 205' surround the base of each dome 210A, 210B, 210C, and 210D. The lights 208' are spaced about the base of the dispensing tower 220. Nevertheless, the lights may be arranged in different configurations.

The lights 205' and 208' may be light emitting diodes (LEDs), low voltage lights or other illuminating means that produce low heat.

One or more rail sections 104A-104G of FIG. 1 may be modified with one or more rail sections 204 or 204' of FIGS. 2A and 2D.

FIG. 3 illustrates a front schematic view of a frosted beer tower rail section 304 for use in the system of FIG. 1 in accordance with some of the exemplary embodiments. In the exemplary embodiment, one end of the rail section 304 has a section connector tab 303 to connect to an adjacent rail section. In the exemplary embodiment, only one tower 320 is shown. However, the rail section 304 may include one or more dispensing towers. The rail section 304 is similar to rail section 204, thus some details are not repeated.

The rail section 304 includes a beer tower mounting rail 306. The center of the rail 306 has mounted thereto the frozen beer dispensing tower 320. However, other beverages may be dispensed from the tower 320. The frozen beer dispensing tower 320 has a tower body 326, made of metal such as stainless steel. While yellow metals may be used, stainless steel may be preferred. The stainless steel tower body 326 has a hollow interior configured to be flooded (filled) with the coolant or refrigerant in the beer lines BCL used to chill the beer or other beverage sent to the tower 320 to be dispensed. The coolant or refrigerant in the beer lines BCL is then returned to the beer chilling system 550 (FIG. 5) via return lines of the beer lines BCL.

The rail 306 is mounted to a bar structure via studs 318. The rail 306 receives and returns the coolant or refrigerant on refrigerant lines RL. The coolant or refrigerant is from rail chilling and frost system 130A, as best seen in FIG. 5. The rail section 304 includes one or more drains 330A, 330B to capture and channel water or fluid of defrosting ice away from and out of the rail section 304.

Figure 4:
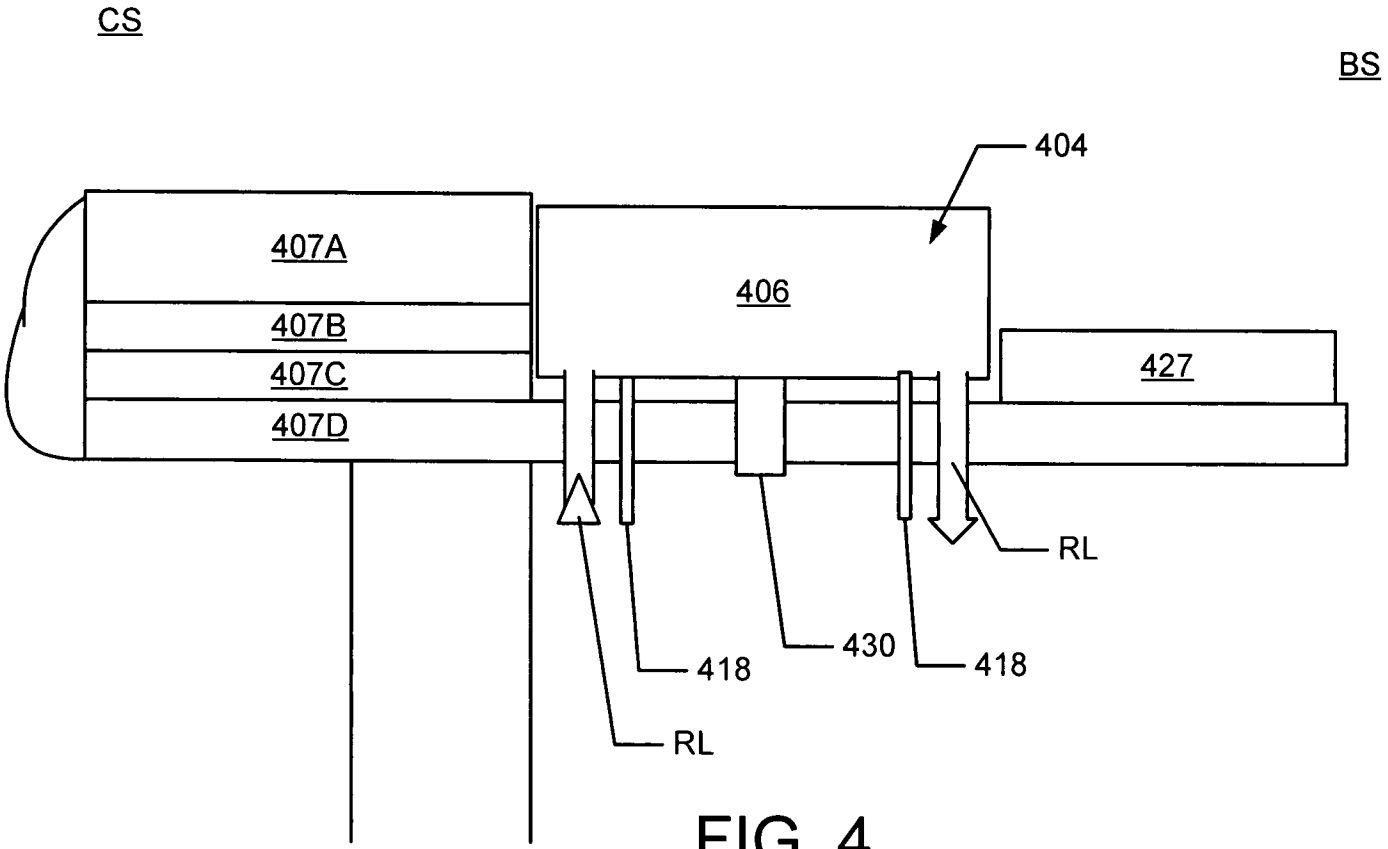
FIG. 4 illustrates a schematic diagram of a bar structure configured for installation of a rail section for a multi-configurable frosted bar rail system in accordance with some exemplary embodiments.

FIG. 4 illustrates a schematic diagram of a bar structure 402 configured for installation in a multi-configurable frosted bar rail system in accordance with some exemplary embodiments. The bar structure 402 can be used to install one or more rail sections (e.g., rail sections 104A-104G) in series.

The rail section 404 may have any of the configurations described herein. The bar structure 402 may include a drink rail system 427 in closest proximity to the bartender side BS of the bar structure 402. The bar structure 402 further includes a customer side CS having a bar top member 407A followed by one or more layers of bar support members 407B, 407C and 407D below the bar top 407A. The layers of bar support members 407B, 407C and 407D are parallel and below the bar top 407A. The bar top 407A may be granite, wood or some other material. The customer side CS of the bar structure has a height that is higher than the drink rail system 427. The lower bar support member 407D extends from the customer side CS to the bartender side BS and supports thereon the drink rail system 427.

Between the customer side CS and the drink rail system 427, the rail 406 may be mounted therebetween via studs 418. The lower bar support member 407D has the apertures formed therein for placement of the drain 430, and coolant/refrigerant lines RL of the rail sections 404.

FIG. 5 illustrates a schematic view of a multi-configurable frosted bar rail system 500 with a frosted beverage chilling and dispensing rail section 504 with lights 505 and 508 in accordance with some of the exemplary embodiments. The system 500 includes a remote dome/rail chilling and frost system 530, a remote beer chilling system 550, and electrical power system 560, all of which are coupled to one or more frosted beverage chilling and dispensing rail sections 504. A timer 565 is connected to the remote dome/rail chilling and frost system 530 and the electrical power system 560 to turn off or on the one or more frosted beverage chilling and dispensing rail sections 504.

A remote beer chilling system 550 is described in U.S. Pat. No. 7,389,647, titled "Closed System and Method for Cooling and Remote Dispensing of Beverages at Guaranteed Temperatures" incorporated herein by reference as if set forth in full below.

The remote dome/rail chilling and frost system 530 employs a refrigerant such as Freon to be chilled to −20° F.--30° F. The remote dome/rail chilling and frost system 530 includes a low-temp refrigeration compressor 535 with a "refrigerant 404A" or Freon or other non-Freon type coolants. An example of a low-temp refrigeration compressor 535 may be available by Dan Foss™, of Germany. The compressor 535 is flooded or filled with a refrigerant for a closed loop system.

The electrical power system 560 may include the electrical system of the bar establishment and connected to the public utility service. However, a battery system may be used.

The one or more frosted beverage chilling and dispensing rail sections 504 are arranged to support the embodiments of FIG. 2D having a frozen beer dispensing tower 220. The one or more frosted beverage chilling and dispensing rail sections 504 includes a top rail plate 507 having a plurality of dome mounting areas, denoted by DMA. Each dome mounting area DMA has an area defined by the dashed lines. The domes 210A, 210B, 210C and 210D (FIG. 2D) are mounted to a respective one dome mounting area DMA. Each dome mounting area DMA is surrounded by a plurality of lights 505 mounted in the frosted dome mounting rail 506. The lights 505 may include an illuminating means, light emitting diodes (LEDs) or low voltage lighting positioned about each of the dome mounting areas DMA. In the exemplary embodiment, the frosted dome mounting rail 506 further includes lights 508 which may be an illuminating means, light emitting diodes (LEDs) or low voltage lighting positioned about the frosted beer dispensing tower 220 (FIG. 2D).

Each dome mounting area DMA has four lights 505 to illuminate around a base of the dome. Nonetheless, instead of positioning the lights 505 around the dome base or dome mounting area DMA, the lights 505 may be arranged in a row along the frosted dome mounting rail 506. In an embodiment, the lights 505 are equally spaced from adjacent lights around the dome base or dome mounting area DMA.

In the embodiment of FIG. 5, only one frosted beverage chilling and dispensing rail section is shown. The frosted beverage chilling and dispensing rail sections 504 includes a frosted dome mounting rail 506 configured to support a plurality of frosted beverage chilling and dispensing domes 210A, 210B, 210C and 210D (FIG. 2D) configured to chill and dispense beverages within the dome. The domes are configured to create snowy white frosted ice or frost around evenly about its perimeter. The frosted beverage chilling and dispensing rail section 504 further includes a tower mounting area TMA to mount a frosted beer dispensing tower 220 thereto. Thus the rail section 504 is a combination rail section.

In an embodiment, frost forms down the dome exterior wall and onto the frosted dome mounting rail 506. Over time, the frost may appear continuous such that a separation between the frost on the dome and the frost on the frosted dome mounting rail 506 appear as continuous with no breaks or separation lines.

In the exemplary embodiment, the coolant lines are coupled to valve-metering devices (VMD) 540 and 542 to deliver a metered amount of coolant to domes. The VMD 540 is associated with domes 1 and 2. The VMD 542 is associated with domes 3 and 4. The amount of coolant is based on the distance or length of the line within the dome and to the dome. The amount of coolant through the rail VMD 545 to the frosted dome mounting rail 506 is a function of the length of coolant lines along the frosted dome mounting rail 506 and to the frosted dome mounting rail 506 to achieve the frost.

In the exemplary embodiment, the VMD 540 and 542 support two separate coolant lines (in and out) to each dome. However, if the rail section 504 has five domes, one of the valve-metering devices could be designed to support three domes to deliver a set amount of coolant to each dome.

The frosted dome mounting rail 506 includes a base pan 511 made of metal, natural material, man-made material or a combination of natural and man-made materials. The base pan 511 includes side walls 512A and 512B and end walls 512C and 512D. The end walls 512C and 512D may be separate end plates or caps configured to be attached, sealed, affixed or integrated to the base pan 511.

The frosted dome mounting rail 506 further comprises a top rail plate 507 made of metal (e.g. stainless steel) having supports flanges or legs (FIGS. 8A-8C) to rest or support the top rail plate 507 within the base pan 511. Frost or snowy white frosted ice is created on a top rail plate 507.

Figure 6A:
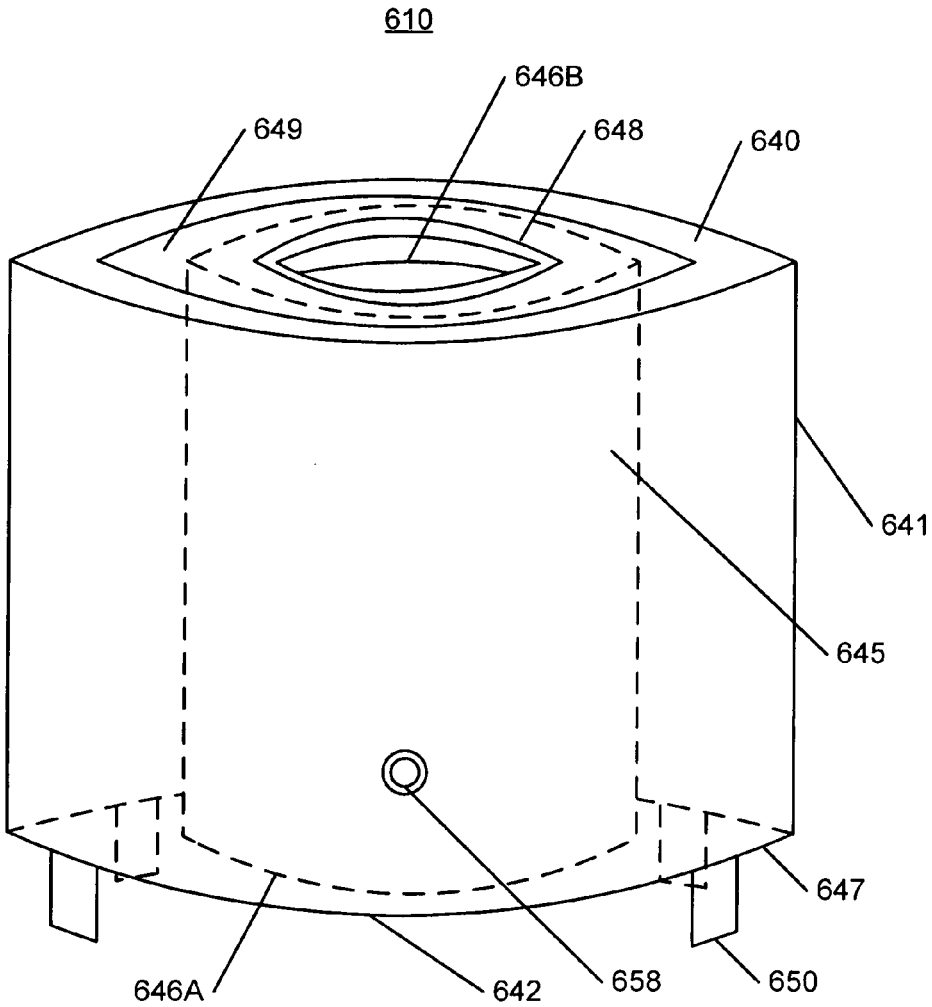
FIG. 6A illustrates a perspective view of an frosted beverage chilling and dispensing dome in accordance with some of the exemplary embodiments.

FIG. 6A illustrates a perspective view of a frosted beverage chilling and dispensing dome 610 in accordance with some of the exemplary embodiments. The dome 610 comprises, in general, a cylindrical shaped structure 640 with a curved exterior perimeter surface 641. In lieu of a curve exterior perimeter 641 or cylindrically shaped dome, a square shape, rectangular shape, truncated-triangular shape, truncated-pyramid shape, truncated-cone shaped, spherical shape or other geometric shapes may be used.

The frosted beverage chilling and dispensing dome 610 further includes an interior cavity 645 (represented by the dashed lines) with a closed bottom end 646A and a top opening 646B. The interior cavity 645 serves as an internal storage and chilling tank. The frosted beverage chilling and dispensing dome 610 includes an access port 658 formed through the curved exterior perimeter surface 641 and the interior cavity 645. A dispensing faucet 216A-216D such as shown in FIG. 2A-2B would be coupled thereto.

The bottom end 642 of the curved exterior perimeter surface 641 has coupled thereto securing tabs 650 to couple the bottom end 642 or dome base of the dome 610 to the frosted dome mounting rail 506 (FIG. 5). The dome 610 is configured to be mounted to a dome mounting area DMA (FIG. 5). The top rail plate 507 includes slots to match the pattern of securing tabs 650. The slot receives the securing tab 650. In an embodiment, the securing tab 650 is configured to be crimped or bent under the top rail plate 507 so that the dome 610 cannot be lifted or moved.

The top center of the dome 610 has a top opening formed therein which corresponds with the top opening 646B of the interior cavity 645. The top opening 646B, in the exemplary embodiment, has a bottle seat 648 coupled thereto. The bottle seat 648 is made of plastic or other natural or man-made materials. The bottle seat 648 cradles and supports a vertically upside-down liquor bottle. In an embodiment, a liner 649 surrounds the bottle seat 648 which is made of Acetal or other hard plastic for the temperature range described herein. Acetal is white in color and can serve as a freeze break so that frost does not grow up the bottle seated in the bottle seat 648.

While not wishing to be bound by theory, frost on the top of the dome 610 is formed in part by the growth of the frost from the sides of the dome 610. The frost will generally stop at the liner 649 or freeze break. The liner 649 provides a freeze break. The liner 649 does not generally form frost thereon and is made of a non-metallic material which would not promote frost development or growth.

Figure 7A:
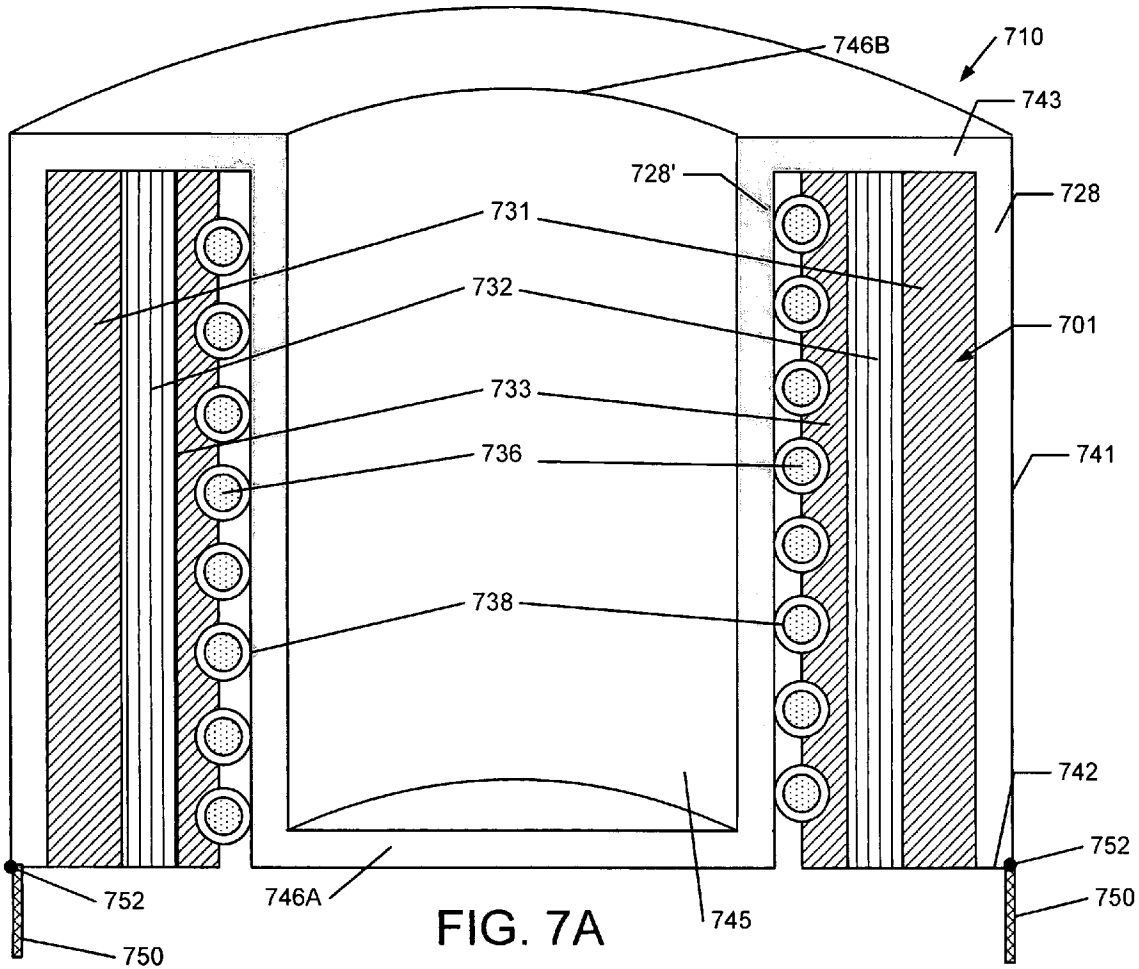
FIG. 7A illustrates a cross sectional view of an frosted beverage chilling and dispensing dome in accordance with some of the exemplary embodiments.

In an embodiment, frost generally does not form under the liner 649 or within the dome's interior. Thus, frost does not form in the interior or interior cavity 645 of the dome 610. The interior cavity 645 is an interior liner within the dome, as best seen in FIG. 7A.

Figure 6B:
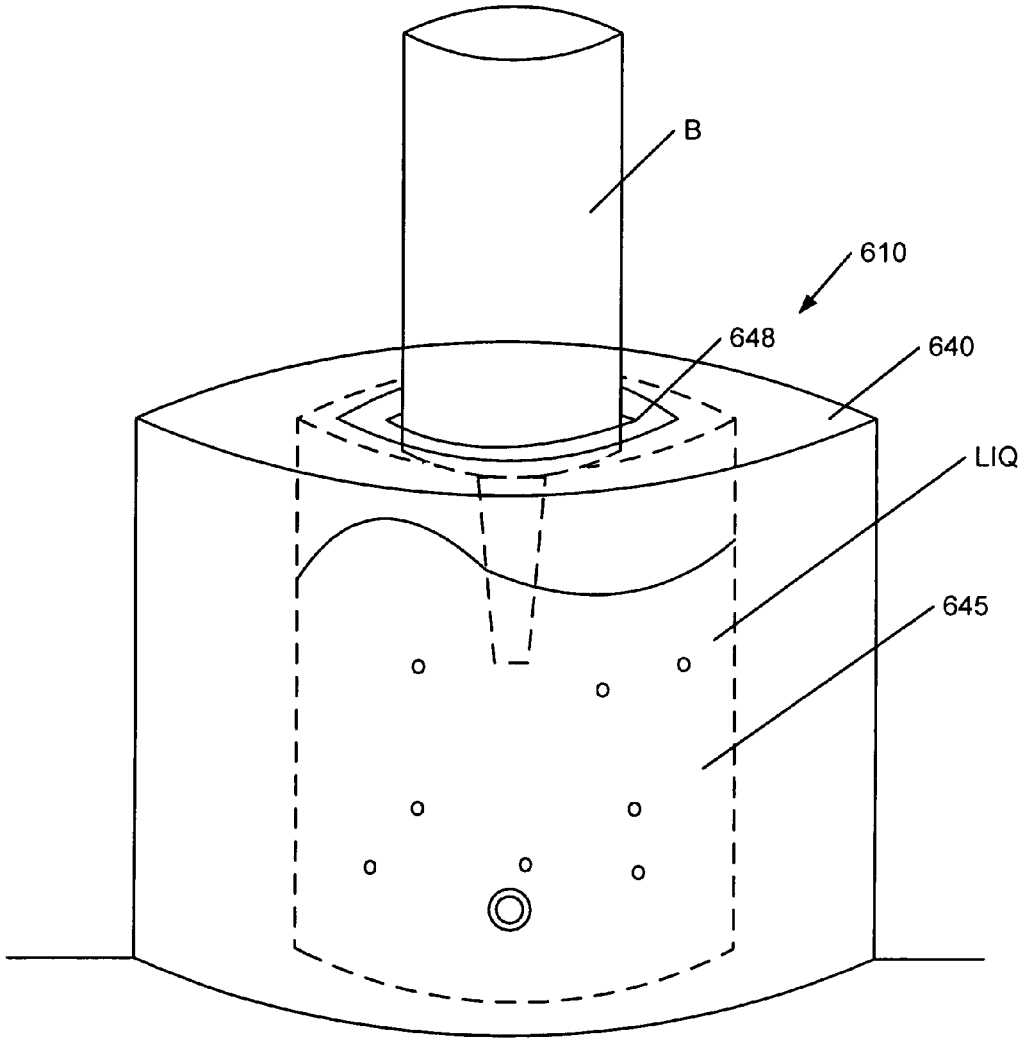
FIG. 6B illustrates a perspective view of an frosted beverage chilling and dispensing dome with a seated liquor bottle in accordance with some of the exemplary embodiments.

FIG. 6B illustrates a perspective view of an frosted beverage chilling and dispensing dome 610 with a seated liquor bottle B in accordance with some of the exemplary embodiments. The liquor bottle B is turned upside down so that the open end of the bottle B can be received within the dome 610 and in the interior cavity 645. The liquor beverage LIQ pours out of the liquor bottle B automatically under the force of gravity. The liquor beverage LIQ from the bottle B is stored in the interior cavity 645. The interior cavity 645 is made of a metal material that is configured to be chilled. The liquor beverage LIQ when in contact with the interior cavity 645 (metal liner) causes the liquor beverage LIQ to chill.

The viscosity of one or more of the liquor beverages LIQ when stored in the dome's interior cavity 645 may change. The liquor beverage LIQ may be thicker than the traditional free flowing liquor beverage at room temperature. The liquor beverage LIQ may not freeze depending on the alcoholic content. Moreover, the viscosity can change.

In the exemplary embodiment, the viscosity may change to be thicker without a frozen slush being formed.

Figure 8A:
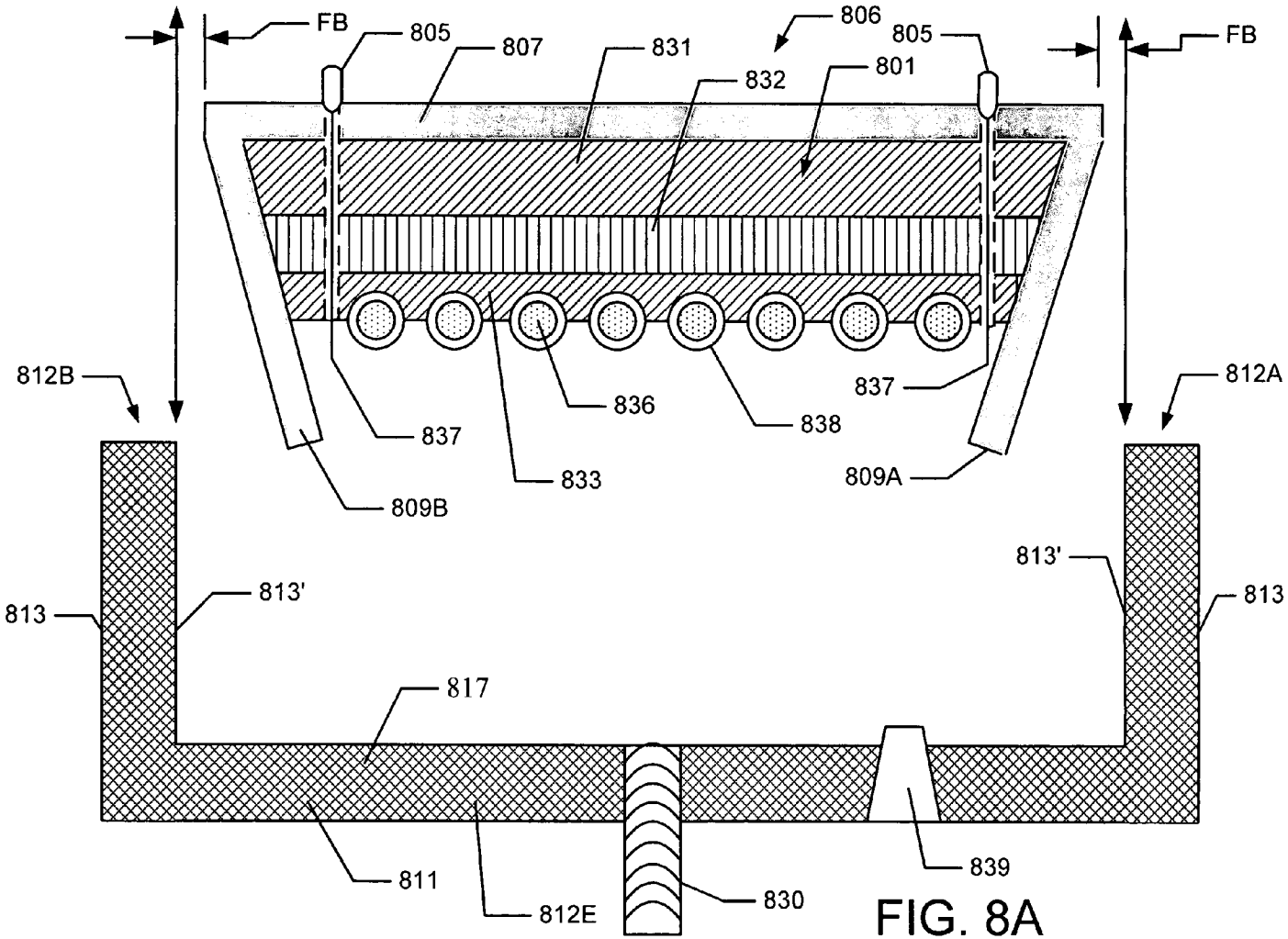
FIG. 8A illustrates a cross sectional view of a frosted dome mounting rail section with a portion raised in accordance with some of the exemplary embodiments.
Figure 8B:
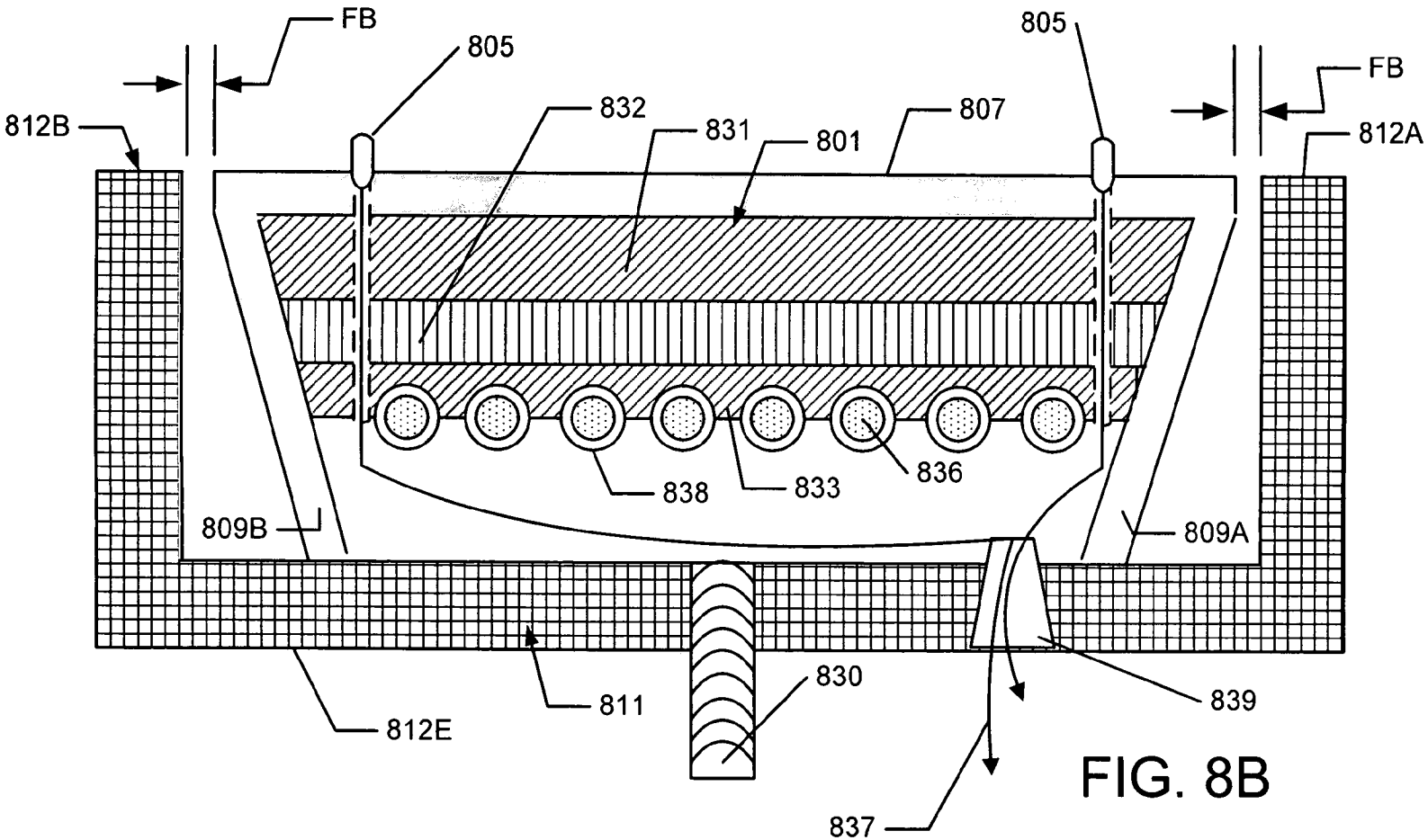
FIG. 8B illustrates cross sectional view of a frosted dome mounting rail section with lights in accordance with some of the exemplary embodiments.
Figure 8C:
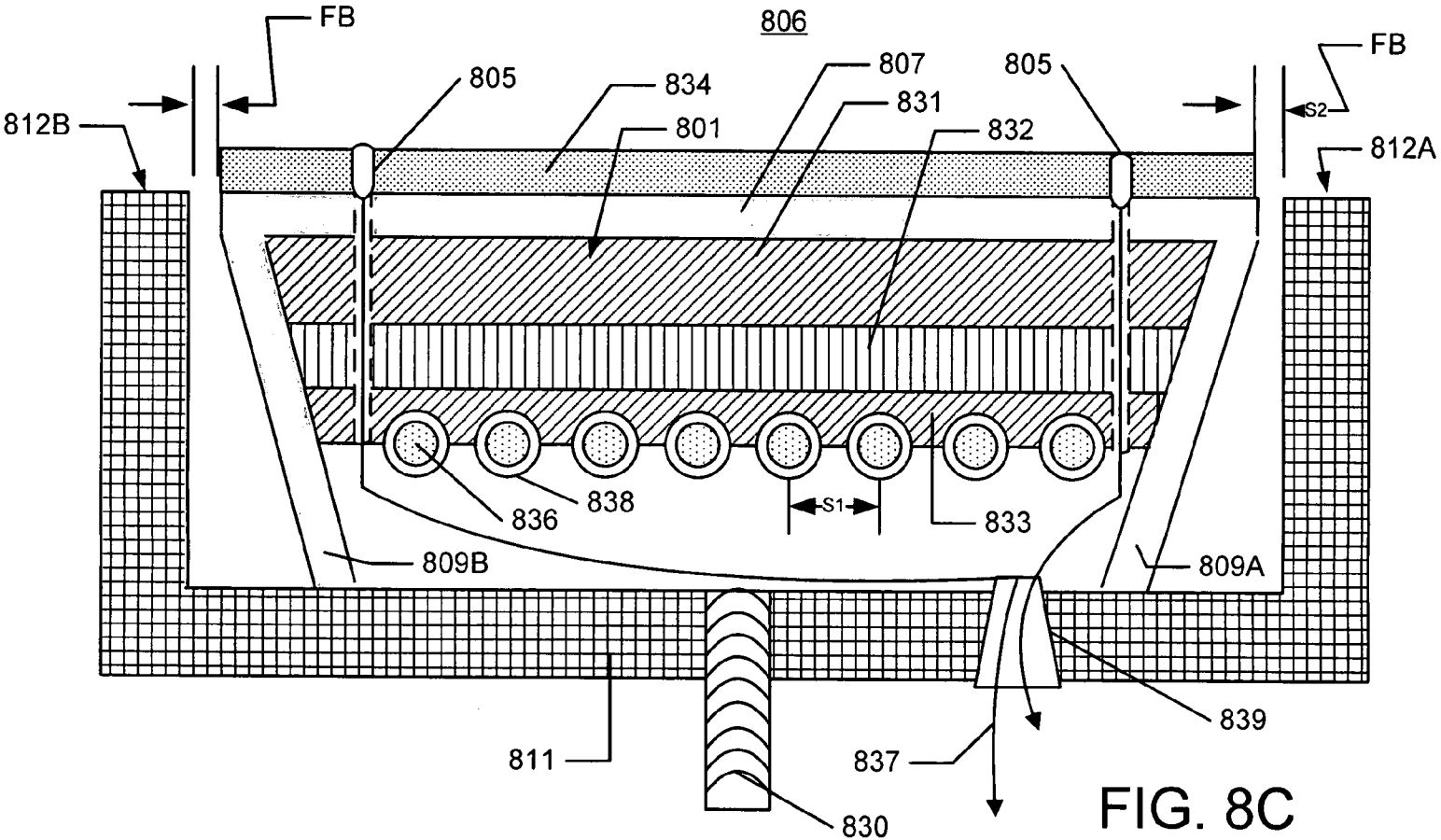
FIG. 8C illustrates cross sectional view of a frosted dome mounting rail section (with ice) in accordance with some of the exemplary embodiments.

FIGS. 8A-8C illustrate a cross sectional of the frosted dome mounting rail 806. FIG. 8A is shown with the rail top plate 807 raised above the base pan 811. FIG. 8C shows a layer of frost or ice 834. The rail of other types of rail sections are similar to the frosted dome mounting rail 806 described below. The frosted dome mounting rail 806 includes a base pan 811. The base pan 811 includes a double insulated wall structure defining a pan or drip pan. The pan 810 includes two side walls 812A and 812B and a floor 812E with a drain 830. The floor 812E also includes a grommet 839 through which electrical wires are fed. The grommet 839 may be rubber or other sealable material that prevents water from flowing through. The two side walls 812A and 812B and base pan 811 form a double insulated wall structure. The double insulated wall structure includes two parallel walls 813 and 813' having insulation 817 therebetween. The insulation 817 may include high density Urethane. The wall 813 has a generally U-shape defining wall 812A, floor 812E and wall 812B. Wall 813' has a generally U-shaped defining wall 812A, floor 812E and wall 812B. The wall 813 and 813' are separated by the insulation 817.

The base pan 811 may be made of metal, natural material, man-made material or a combination of natural and man-made materials. The walls 813 and 813' of the base pan 811, of the exemplary embodiment, may be made of stainless steel or other metals or materials.

The base pan 811 includes two side walls 812A and 812B and two end walls or separate end plates or caps 512C and 512D (FIG. 5) configured to be attached, sealed, affixed or integrated to the base pan 811.

The frosted dome mounting rail 806 further comprises a top rail plate 807 made of metal (e.g. stainless steel) having supports flanges or legs 809A and 809B to rest or support the top rail plate 807 within the base pan 811. A layer of frost or snowy white frosted ice 834 is created on a top rail plate 807 made of metal (e.g. stainless steel).

An objective of the present invention is to create a self wicking frost building rail (e.g., rail 806) that can be placed in any room at room temperature or other temperatures. The air conditioning and heating system may be on so as to cool or heat the ambient air. The ambient air can have a wide range of temperatures (68° F. to 78° F.). Most establishments may want to keep their patrons comfortable as the weather changes. Frost is created in most all room temperatures and may not require any special room temperature. However, humidity should be greater than 0%. In an embodiment, humidity should be greater than 20%. The more the humidity in the ambient air, the quicker the frost may form.

The layer of frost or snowy white frosted ice 834 is created by the freezing and chilling mechanism 801 having refrigerant or coolant 836 in refrigerant lines 838 embedded under the top rail plate 807. The refrigerant lines 838 may carry Freon or other refrigerant that can be chilled to −20° F. to −30° F. The refrigerant lines 838 are separated by a predetermine distance S1 (FIG. 8C). In one example, the distance S1 is 1¼ inches on center. The refrigerant lines 838 may have an OD of ⅜ inches may be coiled or arranged in a serpentine arrangement. The refrigerant lines 838 may have other ODs and the spacing distance S1 may vary. However, the spacing between refrigerant lines 838 should be such that a continuous sheet of frost or snowy white frosted ice 834 is created uniformly on top of the top rail plate 807. The freeze break FB is approximately 1/16-1/8 of an inch.

While not wishing to be bound by theory, the continuous and uniform sheet or layer of frost or ice 834 is created by continuous and uniform layers of thermally conductive materials which may be metallic and non-metallic with high thermal conductivity factors. A top layer 831, immediately below the top rail plate 807, includes a thermal compound. In an embodiment, the thermal compound of the top layer 831 is non-metallic but is highly conductive of temperature and especially cold temperatures. Thus, top layer 831 is a first non-metallic thermal layer.

The thermal compound is followed by a metal thermal conductor layer 832 such as a sheet of metal with a high thermal conductivity. The metal thermal conductor layer 832 may include metals with a thermal conductivity factor greater than 90 or 100, such as without limitations aluminum, silver, gold, copper, etc. The top rail plate 807 is made of a metal which has a thermal conductivity factor which is less than 90 or 100.

Below the metal thermal conductor layer 832 there is another thermal compound layer (hereinafter referred to as "the second non-metallic thermal layer 833") with the refrigerant lines 838 partially or fully embedded therein. The layers of metallic and non-metallic layers (e.g., layers 831, 832 and 833) channel the cold temperatures in the refrigerant lines 838 upward to the top rail plate 807 where self-wicking of moisture takes place by drawing in and freezing the moisture or water in the ambient air (humidity). The freezing and chilling mechanism 801 includes the layers of metallic and non-metallic layers (e.g., layers 831, 832 and 833).

The lights 805 are LEDs or low voltage lights installed or embedded in the top rail plate 807 and layers 831, 832 and 833. The electrical wires 837 to the lights 805 are fed to the grommet 839. The lights 805 create little heat. However, the heat limits or minimizes the frost from completely covering the lights 805.

It should be noted that leaving the system 100 or 500 on will increase the depth of the layer of frost or snowy white frost or ice 834 on the domes and rail, as frost will keep building. Therefore, to control the height of the frost or snowy white frost or ice 834, the system needs to be turned off at periodic intervals such as at the end of the business day/night. Additionally, the amount of humidity may increase the height of the frost generated. The more humidity the thicker (taller) the layer of frost or snowy white frost or ice 834.

Figure 7B:
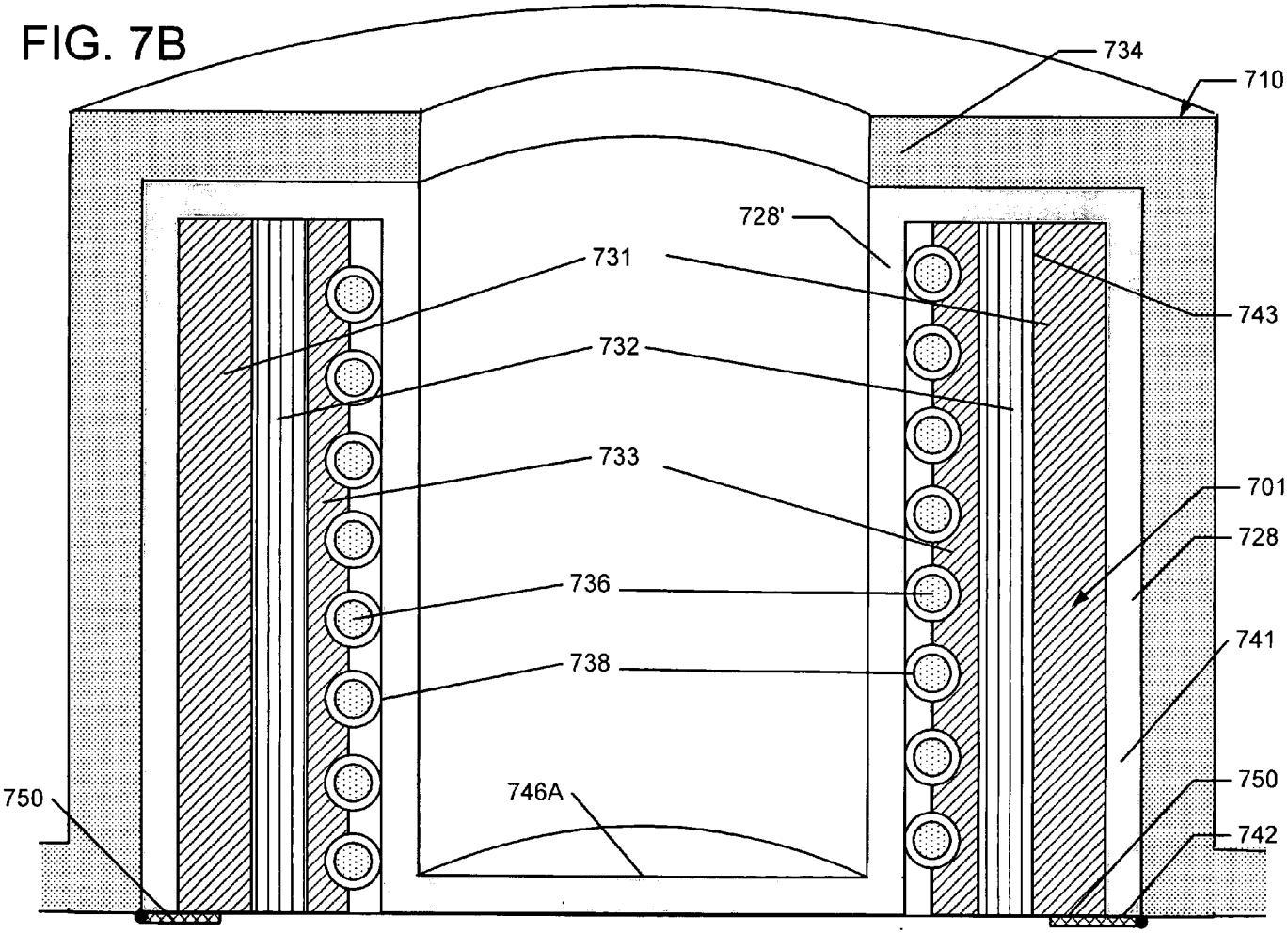
FIG. 7B illustrates a cross sectional view of an frosted beverage chilling and dispensing dome with frosted ice in accordance with some of the exemplary embodiments.

FIG. 7A illustrates a cross sectional view of a frosted beverage chilling and dispensing dome 710 in accordance with some of the exemplary embodiments. FIG. 7B illustrates a cross sectional view of an frosted beverage chilling and dispensing dome 710 with a layer of frosted ice 734 in accordance with some of the exemplary embodiments. The liner 649 (FIG. 6A) for the seat is not shown in FIGS. 7A-7B.

The layer of frosted ice 734 is created by the dome 710 in a similar manner as the rail 806 (FIG. 8A-8C) previously described. The dome 710 includes two concentric walls 728 and 728' to form the exterior wall 741 and the interior wall 745. The interior wall 745 serves as the interior cavity 645 (FIG. 6). The exterior wall 741 and the interior wall 745 are joined together with a top wall 743. The exterior wall 741, interior wall 745 and top wall 743 form a U-shaped. The gap between the exterior wall 741 and the interior wall 745 forms a gap under the top wall 743.

Within this gap the freezing and chilling mechanism 701 is placed. The freezing and chilling mechanism 701 includes (adjacent to the exterior wall 741 made of metallic material) a first non-metallic thermal layer 731 of a thermal compound which is concentric to the exterior wall 741 or dome rail plate. In an embodiment, the thermal compound is non-metallic but is highly conductive of temperature and especially cold temperatures. The thermal compound is followed by a metal thermal conductor layer 732 (such as a sheet of metal with a high thermal conductivity) concentric with the exterior wall 741. The metal thermal conductor layer 732 may include metals with a thermal conductivity factor greater than 90 or 100, such as without limitations aluminum, silver, gold, copper, etc. The dome rail plate (exterior wall 741) is made of a metal which has a thermal conductivity factor which is less than 90 or 100.

Adjacent the metal thermal conductor layer 732 there is another layer of a thermal compound (hereinafter referred to as "the second non-metallic thermal layer 733") with the refrigerant lines 738 partially or fully embedded therein. The concentric layers of metallic and non-metallic layers (e.g., layers 731, 732 and 733) channel the cold temperatures in the refrigerant lines 738 sideways or horizontally to the exterior wall 741 (dome rail plate) where self-wicking of moisture takes place by drawing in and freezing the moisture or water in the ambient air (humidity).

The refrigerant lines 738 with refrigerant or coolant 736 also chill the interior wall 745 (inner most dome wall) without frost build up. The refrigerant lines 738 with refrigerant or coolant 736 create in combination with the freezing and chilling mechanism 701 the layer of frost or ice. The interior wall 745 becomes very cold to chill the liquor beverage to be stored therein. The interior of the dome is sufficiently sealed or closed off from humidity of the ambient air to prevent the formation of frost in the interior. The freeze break, area of the seat plastic, stops the frost from building as per the seat plastic. The interior cavity or interior wall 745 includes a bottom end 746A and a top end 746B. The top end 746B coincides with the opening into the dome 710 or interior cavity.

The bottom end 742 of the exterior wall 741 has coupled thereto securing tabs 750 to couple the bottom end 742 or dome base of the dome 710 to the frosted dome mounting rail 506 (FIG. 5). The dome 710 is configured to be mounted to a dome mounting area DMA (FIG. 5). The top rail plate 507 includes slots to match the pattern of securing tabs 750. The slot receives the securing tab 750. In an embodiment, the securing tab 750 is configured to be crimped or bent under the top rail plate 507 so that the dome 710 cannot be lifted or moved. The securing tab 750 is secured to the exterior wall 741 via a spot weld 752. However, the securing tab 750 may be integrated with the exterior wall 741 without the need for welding.

Figure 9A:
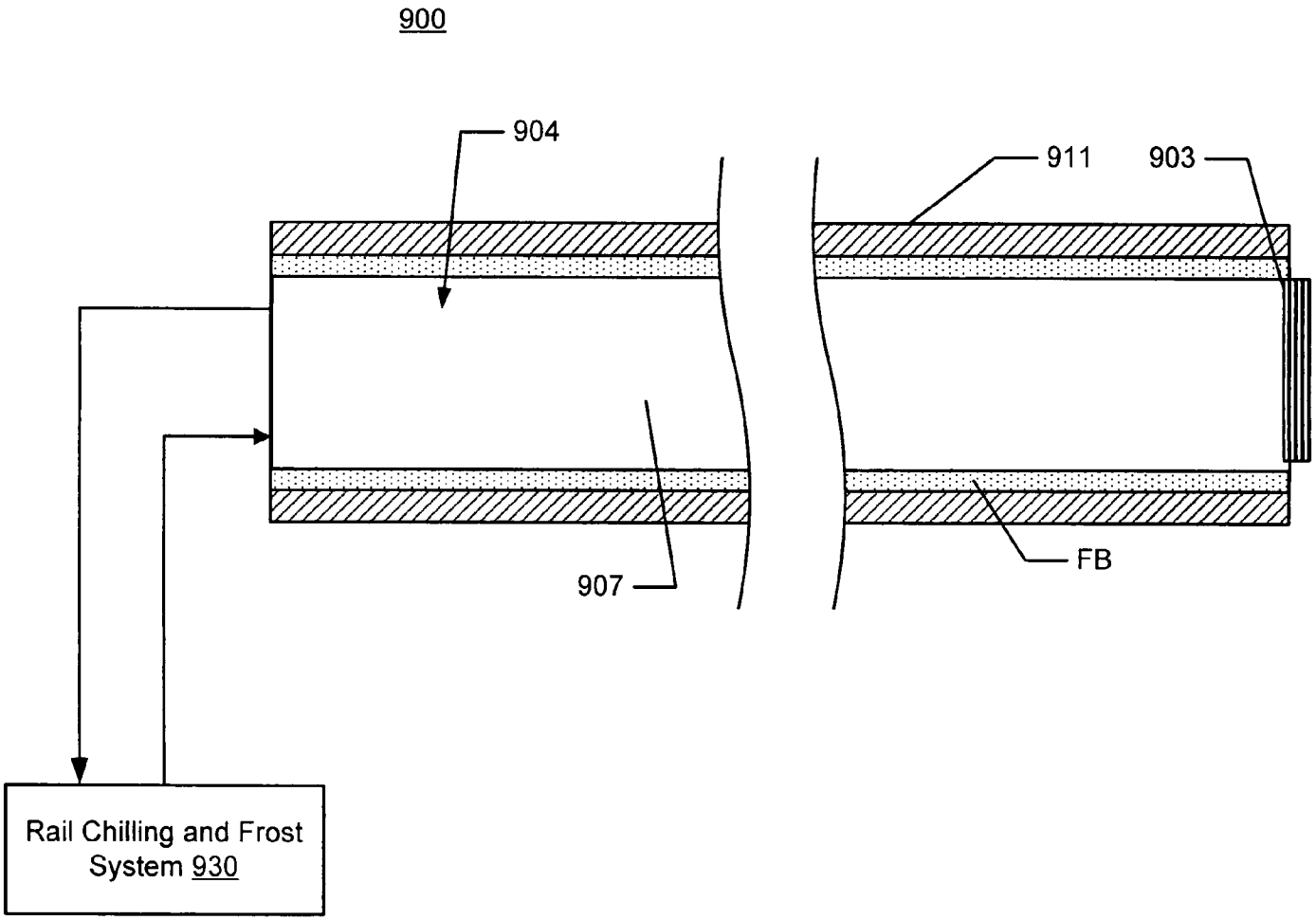
FIG. 9A illustrates a top view of a frosted rail section without lights for a multi-configurable frosted bar rail system in accordance with some of the exemplary embodiments.

FIG. 9A illustrates a top view of a frost rail section 904 without lights for a multi-configurable frosted bar rail system 900 in accordance with some of the exemplary embodiments. An objective of the present invention is to create a frost rail section 904 of any one of the configurations described herein which includes a self wicking frost building rail (see description above) that can be placed in any room at room temperature or other temperatures.

All rail sections 104A-104G (FIG. 1) are of the same general design that can be modified to adapt for accessory additions, lights, domes, beer dispensing towers, etc. All rail sections 104A-104G (FIG. 1) are configured such that the frost or snowy white frosted ice is created by the freezing and chilling mechanism 801 (FIG. 8) receiving refrigerant in refrigerant lines embedded under the top rail plate 907. The refrigerant is received from and returned to the rail chilling and frost system 930.

The rail section 904 includes a base pan 911, a top rail plate 907 supported within the base pan 911 and a freeze break FB. On a short end of the rail section 904, a section connector tab 903 is provided to friction fit coupled to the next or adjacent rail section.

The rail section 904 has no accessories and is constructed and arranged to provide a layer of frost or snow continuously along the top rail plate 907.

Figure 9B:
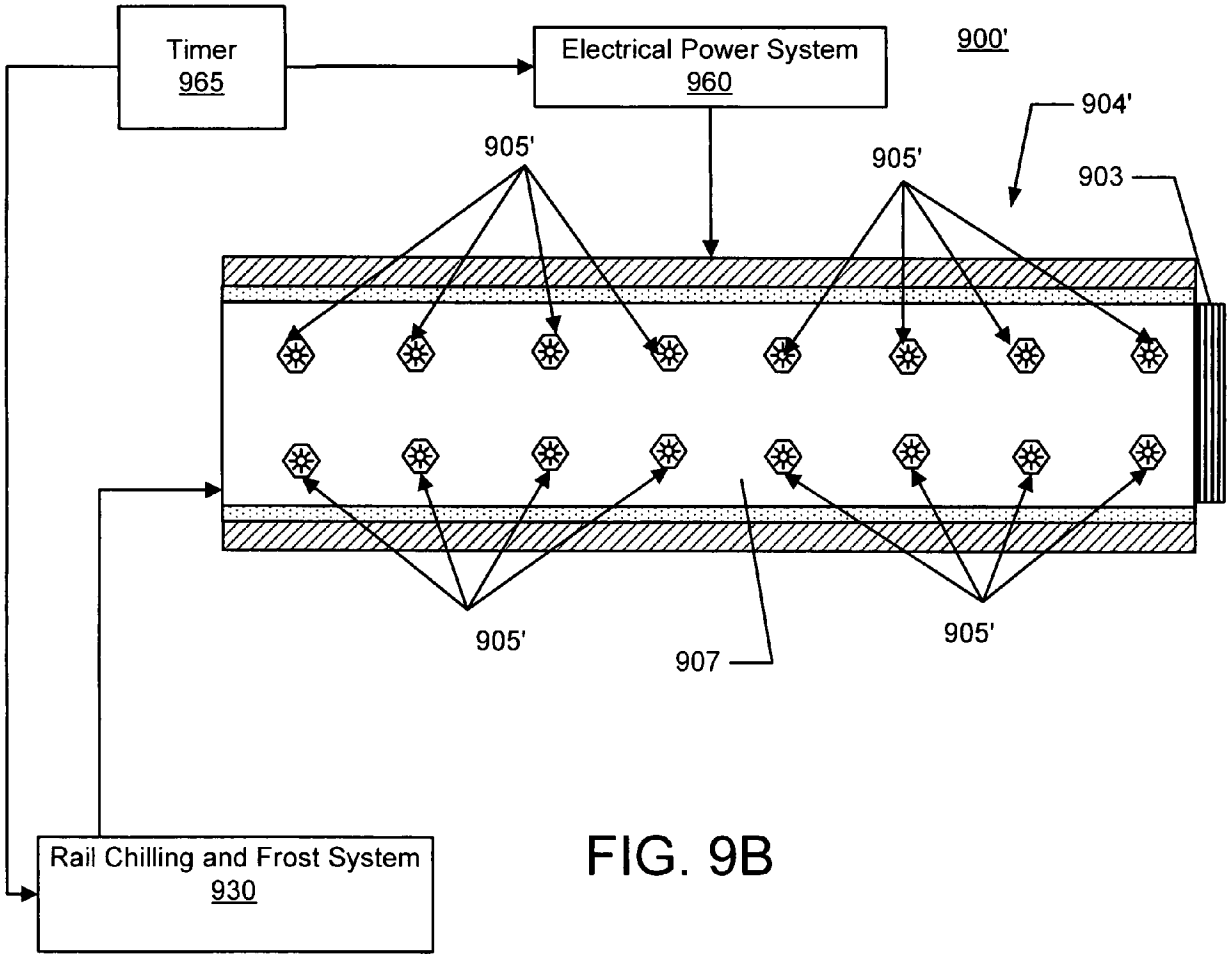
FIG. 9B illustrates a top view of a frosted rail section with lights for a multi-configurable frosted bar rail system in accordance with some of the exemplary embodiments.

FIG. 9B illustrates a top view of a frost rail section 904' with lights 905' for a multi-configurable frosted bar rail system 900' in accordance with some of the exemplary embodiments. The frost rail section 904' of FIG. 9B is similar to that of FIG. 9A except that it includes lights 905'.

The system 900' further includes timer 965 and electrical power system 960. The timer 965 may turn off the system 900' to cause the system to defrost. The rail section 904' connects to an adjacent rail section via connector tab 903.

The rail section 904 has light 905' spaced along the top rail plate 907. The rail section 904 is constructed and arranged to provide a layer of frost or snow continuously along the top rail plate 907.

Figure 10A:
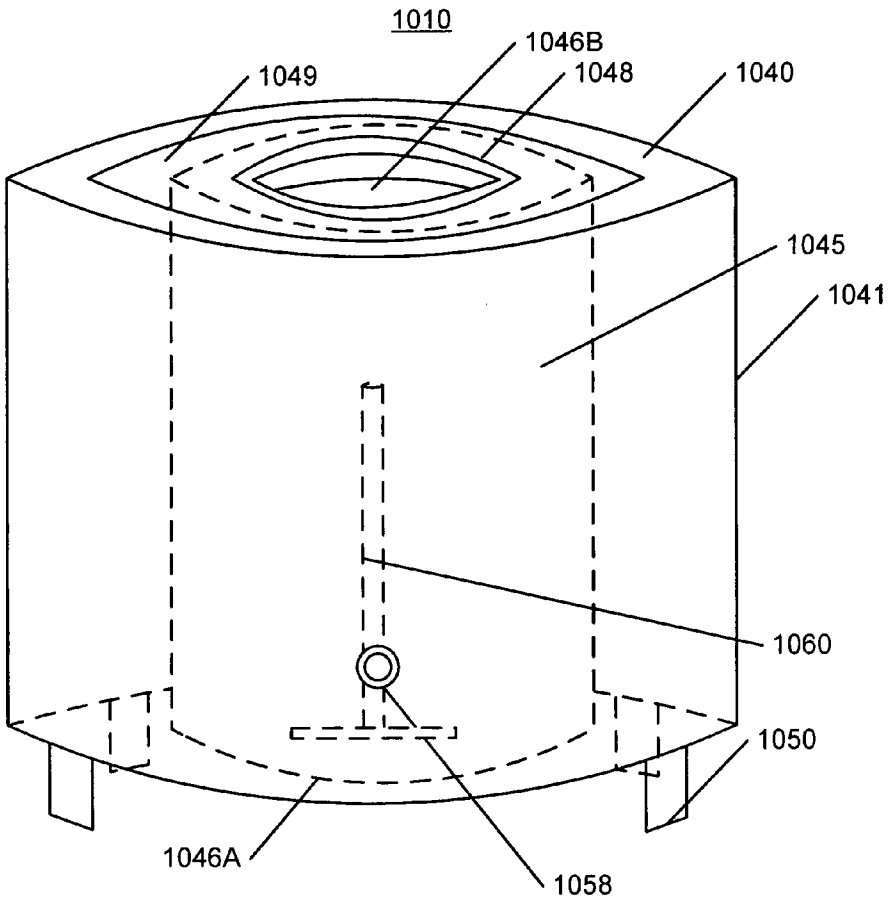
FIG. 10A illustrates a view of the interior of the dome with a bottle stabilizing bar in accordance with some of the exemplary embodiments.
Figure 10B:
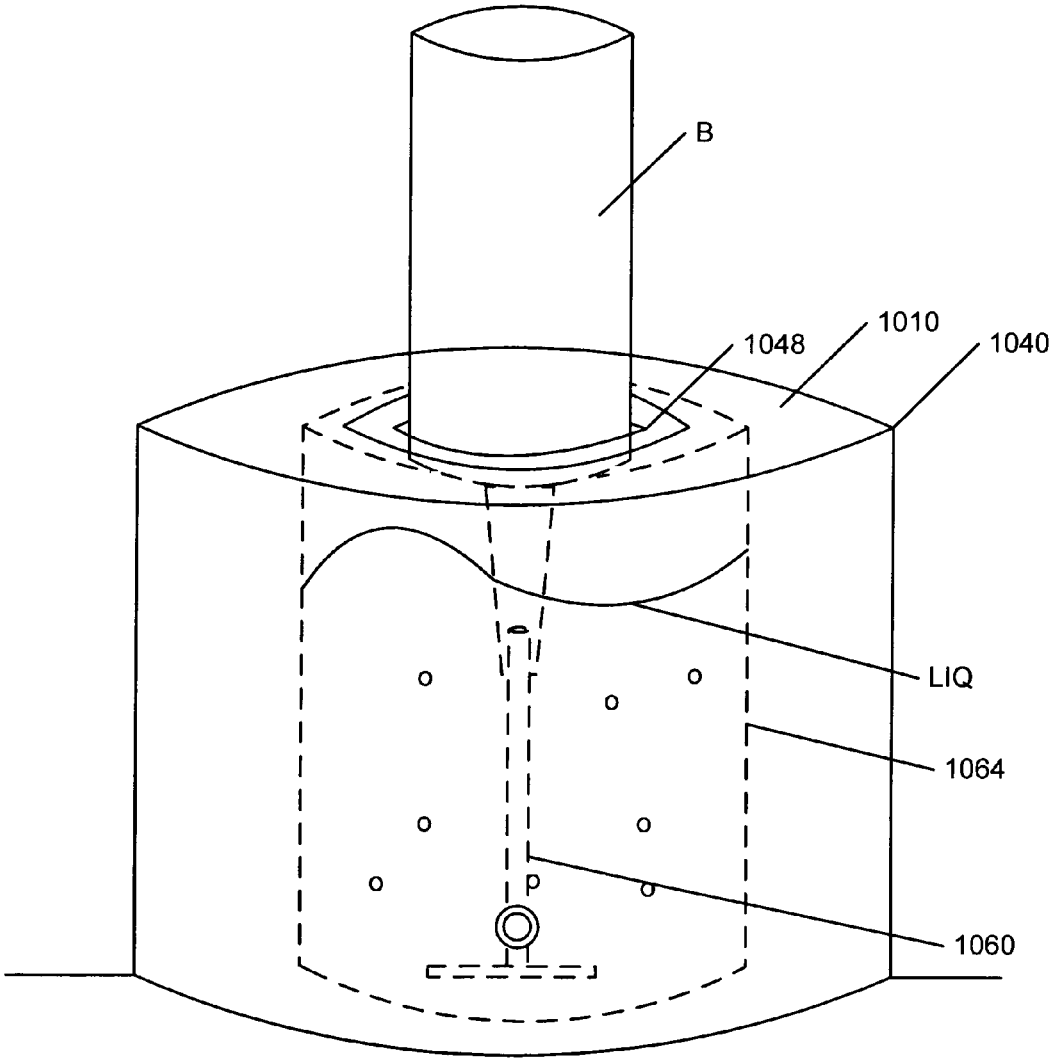
FIG. 10B illustrates a view of the interior of the dome with a bottle stabilizing bar stabilizing a bottle in accordance with some of the exemplary embodiments.

FIG. 10A illustrates a view of the interior of the dome 1010 with a bottle stabilizing bar 1060 in accordance with some of the exemplary embodiments. FIG. 10B illustrates a view of the interior of the dome 1010 with a bottle stabilizing bar 1060 stabilizing a bottle B in accordance with some of the exemplary embodiments. The dome 1010 comprises, in general, a cylindrical shaped structure 1040 with a curved exterior perimeter surface 1041. In lieu of a curve exterior perimeter 1041 or cylindrically shaped dome, a square shape, rectangular shape, truncated-triangular shape, truncated-pyramid shape, truncated-cone shaped, spherical shape or other geometric shapes may be used.

The frosted beverage chilling and dispensing dome 1010 further includes an interior cavity 1045 (represented by the dashed lines) with a closed bottom end 1046A and a top opening 1046B. The interior cavity 1045 serves as an internal storage and chilling tank. The frosted beverage chilling and dispensing dome 1010 includes an access port 1058 formed through the curved exterior perimeter surface 1041 and the interior cavity 1045. A dispensing faucet 216A-216D such as shown in FIG. 2A-2B would be coupled thereto.

The bottom end of the curved exterior perimeter surface 1041 has coupled thereto securing tabs 1050 to couple the bottom end or dome base of the dome 1010 to the frosted dome mounting rail 506 (FIG. 5). The dome 1010 is configured to be mounted to a dome mounting area DMA (FIG. 5).

The top center of the dome 1010 has a top opening formed therein which corresponds with the top opening 1046B of the interior cavity 1045. The top opening in an embodiment has a bottle seat 1048 coupled thereto. The bottle seat 1048 is made of plastic or other natural or man-made materials. The bottle seat 1048 cradles and supports a vertically upside-down liquor bottle. In an embodiment, a liner 1049 surrounds the bottle seat 1048 which is made of Acetal or other hard plastic for the temperature range described herein. Acetal is white in color and can serve as a freeze break so that frost does not grow up the bottle seated in the bottle seat 1048.

The liquor bottle B is turned upside down so that the open end of the bottle B can be received within the dome 1010 and in the interior cavity 1045. The liquor beverage LIQ pours out of the liquor bottle B automatically under the force of gravity. The liquor beverage LIQ from the bottle B is stored in the interior cavity 1045. The operation of the dome 1010 is the same as domes 610 and 710 previously described. Thus, no further description is necessary.

The bottle B, when seated in the vertically inverted position may possibly be tipped over as workers move and work. Thus, in an effort to prevent accidental toppling of the bottle B from the dome seat 1048, a stabilizing bar 1060 is positioned within the dome's interior cavity 1045. The stabilizing bar 1060 is a thin rod capable of being journalled within the bottle B without blocking the flow of liquor out of the bottle B. The stabilizing bar 1060 and dome liner (interior cavity 1045) should be made of material that is rated as food grade. The stabilizing bar 1060 may be made of Acetal. As can be appreciated other stabilizing mechanisms to prevent the bottle from toppling out of the seat may be used. The stabilizing bar 1060 is secured in the dome's interior cavity 1045.

Figure 11:
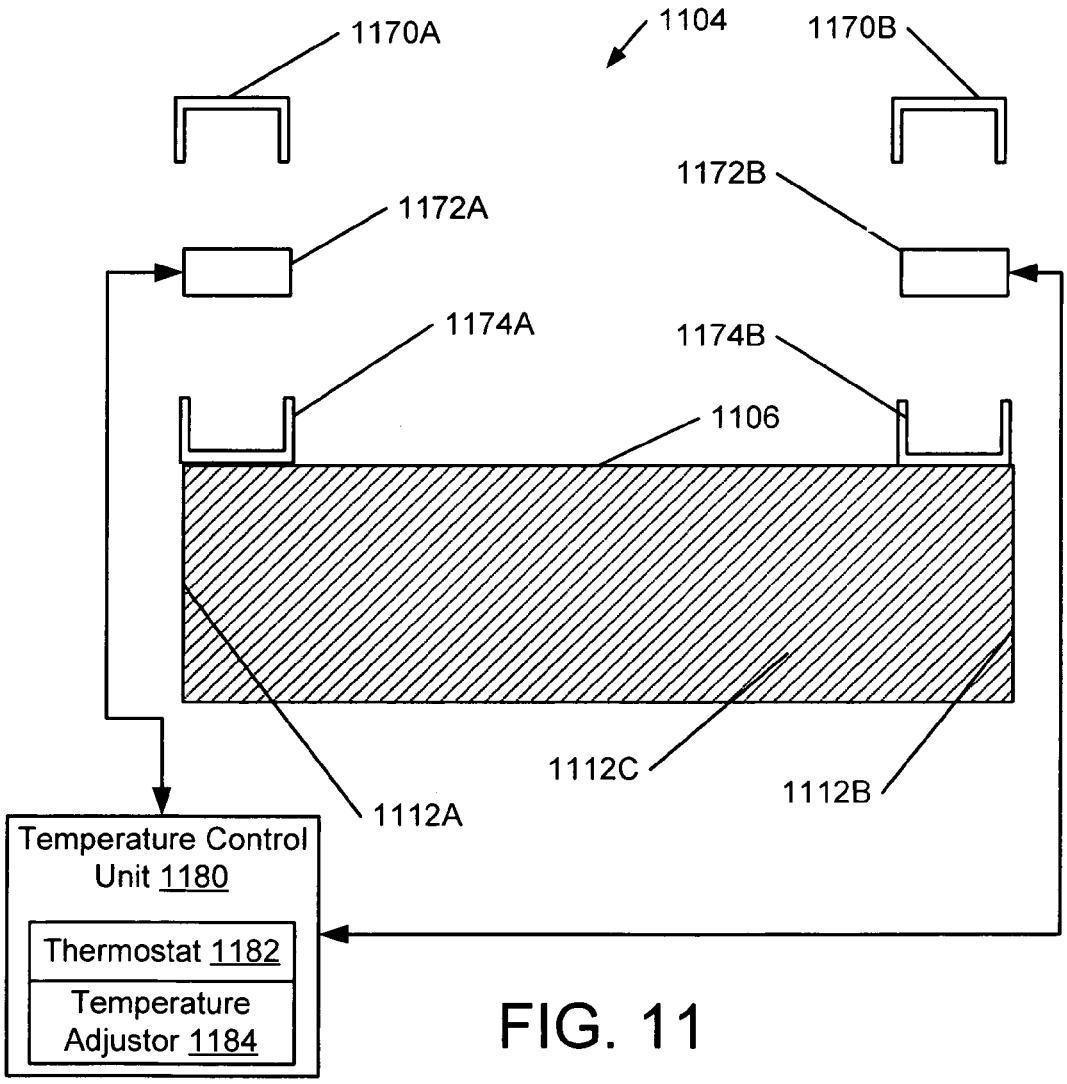
FIG. 11 illustrates an end view of yet another frosted rail section in accordance with some exemplary embodiments of the present invention.

FIG. 11 illustrates an end view of yet another frosted beverage chilling and dispensing device in accordance with some exemplary embodiments of the present invention. The frosted beverage chilling and dispensing device 1104 is similar to the devices 504 and 804 with the exception that heater wires are embedded in the side walls. The frosted beverage chilling and dispensing device 1104 includes a frosted dome mounting rail 1106 having a top rail plate 1107 and base pan 1111. The base pan 1111 includes two end plates (only 1112C shown), side walls 1112A and 1112B.

In the embodiment of FIG. 11, the elongated heating wires 1172A and 1172B, respectively, are within a closed channel at the top of side walls 1112A and 1112B. The closed channel for the elongated heating wire 1172A is defined by the closure of U-shaped channels 1170A and 1174A. The closed channel for the elongated heating wire 1172B defined by the closure of U-shaped channels 1170B and 1174B. The channels 1174A and 1174B are at the top of side walls 1112A and 1112B.

A temperature control unit 1180 is provided to control the heat along each of the elongated heating wires 1172A and 1172B within the closed channels. The temperature control unit 1180 includes a thermostat 1182 and a temperature adjustor 1184. The thermostat monitors the temperature along each of the elongated heating wires 1172A and 1172B. The temperature adjustor 1184 allows the temperature to be controlled or adjusted to a particular threshold. The heat/temperature from the elongated heating wires 1172A and 1172B is set to eliminate condensation. The heat caused the evaporation of water to take place during operation to eliminate condensation during operation of the frosted beverage chilling and dispensing device 1104. The heat also prevents ice from jumping off of the device 1104 and forming elsewhere.

Figure 12A:
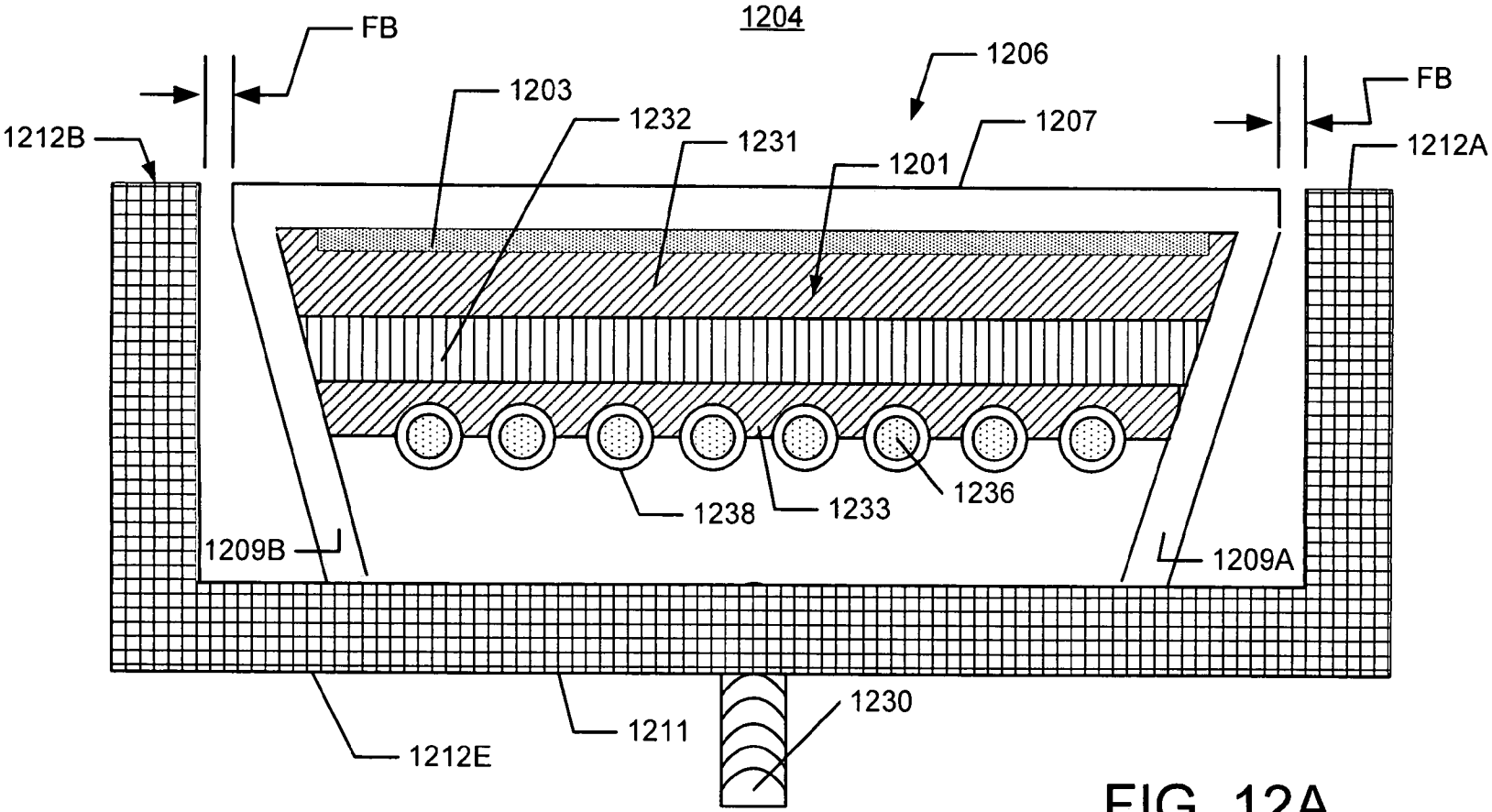
FIG. 12A illustrates a first end view of a frosted rail section with the end plate removed in accordance with some of the exemplary embodiments.
Figure 12B:
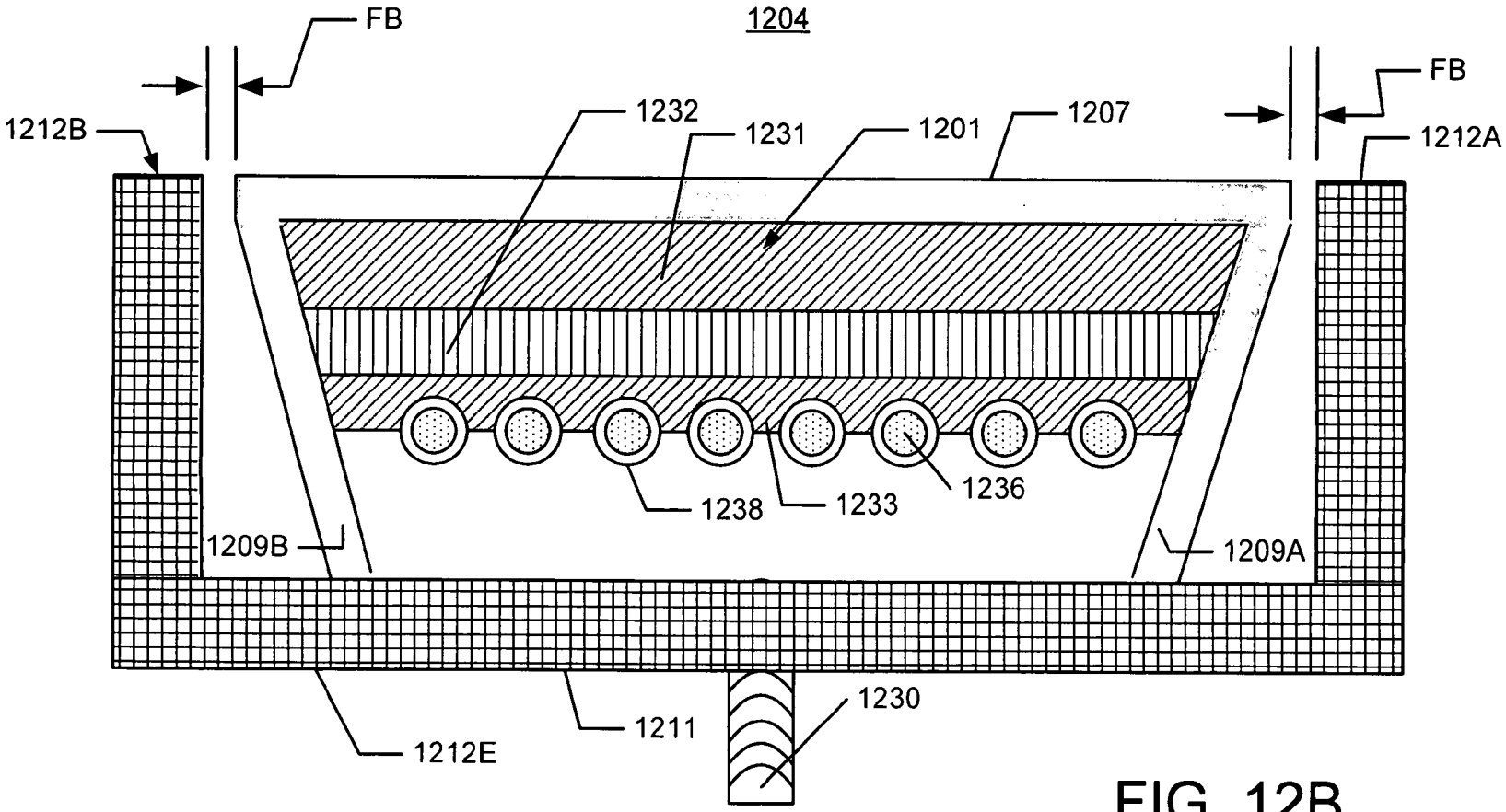
FIG. 12B illustrates a second end view of a frosted rail section with the end plate removed in accordance with some of the exemplary embodiments.

FIGS. 12A and 12B illustrate first and second end views of the rail section 1204 with the end plate removed in accordance with some of the exemplary embodiments. Here the section connector tab 1203 is shown installed under the top rail plate 1207 along one side (short side) of the rail section 1204. The thermal compound (first non-metallic layer 1231) is placed immediately under and around the section connector tab 1203. The connector tab 1203 may be a sheet of metal that has a thin profile.

The rail section 1204 includes a rail 1206. The rail 1206 includes a base pan 1211. The base pan 1211 includes a double insulated wall structure defining a pan or drip pan. The pan 1211 includes two side walls 1212A and 1212B and a floor 1212E with a drain 1230. The floor 1212E also includes a grommet (NOT SHOWN) through which electrical wires are fed.

The rail 1206 further comprises a top rail plate 1207 made of metal (e.g. stainless steel) having supports flanges or legs 1209A and 1209B to rest or support the top rail plate 1207 within the base pan 1211. A layer of frost or snowy white frosted ice is created on a top rail plate 1207.

The layer of frost or snowy white frosted ice is created by the freezing and chilling mechanism 1201 having refrigerant or coolant 1236 in refrigerant lines 1238 embedded under the top rail plate 1207. The refrigerant lines 1238 may carry Freon or other refrigerant that can be chilled to −20° F. to −30° F. The layers of metallic and non-metallic layers (e.g., layers 1231, 1232 and 1233) channel the cold temperatures in the refrigerant lines 1238 upward to the top rail plate 1207 where self-wicking of moisture takes place by drawing in and freezing the moisture or water in the ambient air (humidity). The freezing and chilling mechanism 1201 includes the layers of metallic and non-metallic layers (e.g., layers 1231, 1232 and 1233). A freeze break FB is provided between the top rail plate 1207 and the side walls.

With respect to FIG. 12B, the second end does not include a connector tab. The thermal compound immediately adjacent the top rail plate 1207 is configured to embed a portion of a section connector tab therein from an adjacent rail section. The thermal compound is generally resilient during installation and can be punctured or pierced with the connector tab of an adjacent rail section so that the connector tab is friction fit coupled in the thermal compound. The connector tab can serve as a level to level the top rail plate of adjacent sections.

Figure 13A:
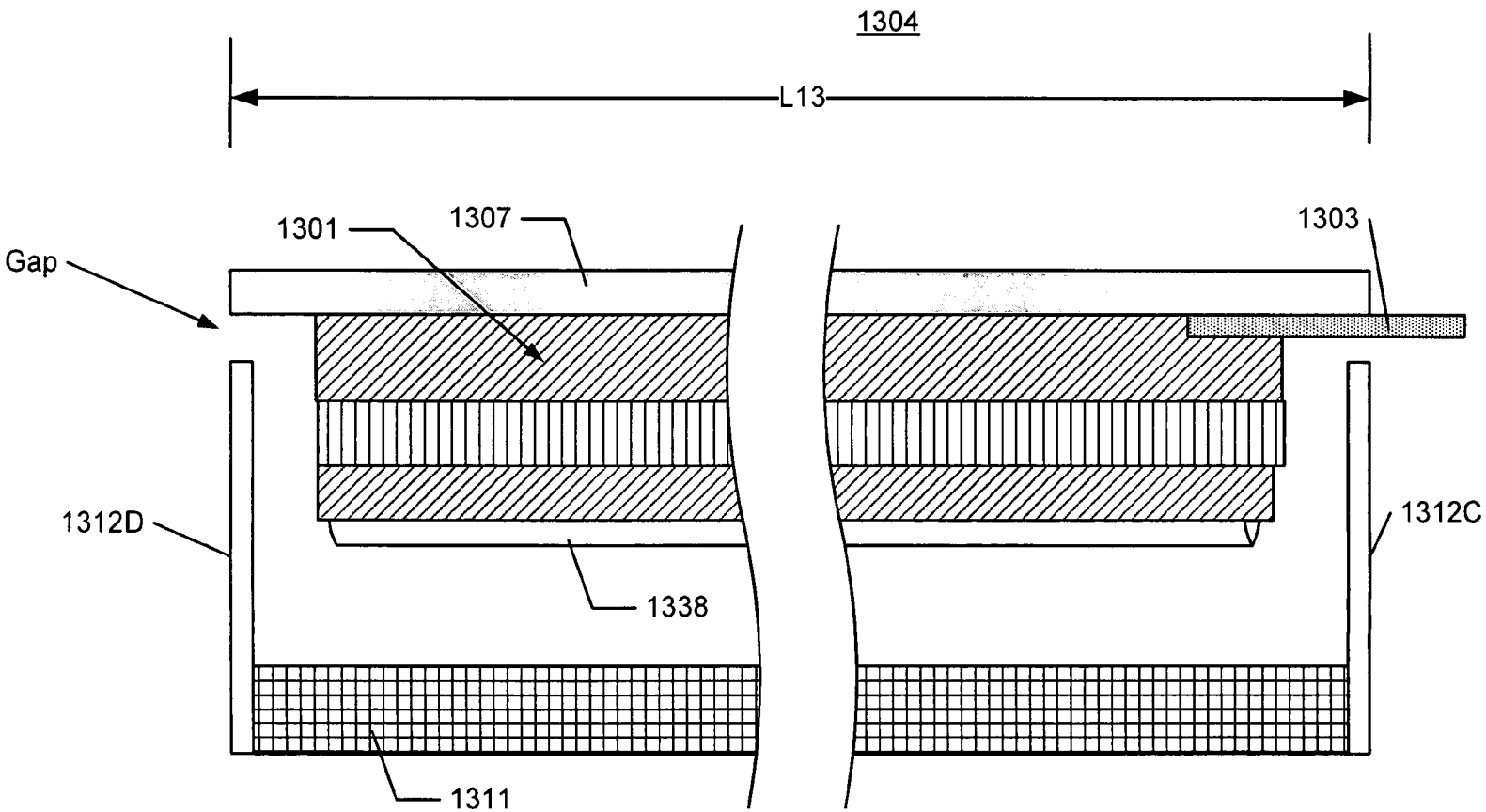
FIG. 13A illustrates a longitudinal cross-sectional view of a frosted rail section in accordance with some of the exemplary embodiments.

FIG. 13A illustrates a longitudinal cross-sectional view of the rail section 1304 in accordance with some of the exemplary embodiments. The section connector tab 1303 is shown installed under the top rail plate 1307 along one side (short side) of the rail section 1304. The thermal compound (first non-metallic layer) of the freezing and chilling mechanism 1301 is placed immediately under and around the section connector tab 1303. The end plate 1312C of the rail section 1304 has sufficient clearance under the section connector tab 1303. Along the other side opposite the one side, the end plate 1312D is below the top rail plate 1307 such that a gap or clearance GAP is provided to slide, slip, inject or pass therethrough, the section connector tab of an adjacent rail section. The end plates 1312C and 1312D may be affixed to the drip pan 1311 using an adhesive for waterproofing and/or attachments. Nonetheless, other means of attaching the end plates to the drip pan 1311 may be used such as welding. The end plates 1312C and 1312D may also be fastened or drawn together to couple the two sections together to form one modular unit.

The rail section 1304 has a length L13 which may be 48 inches, 60 inches or other dimensions.

The layers of metallic and non-metallic layers channel the cold temperatures in the refrigerant lines 1338 upward to the top rail plate 1307 where self-wicking of moisture takes place by drawing in and freezing the moisture or water in the ambient air (humidity).

Figure 13B:
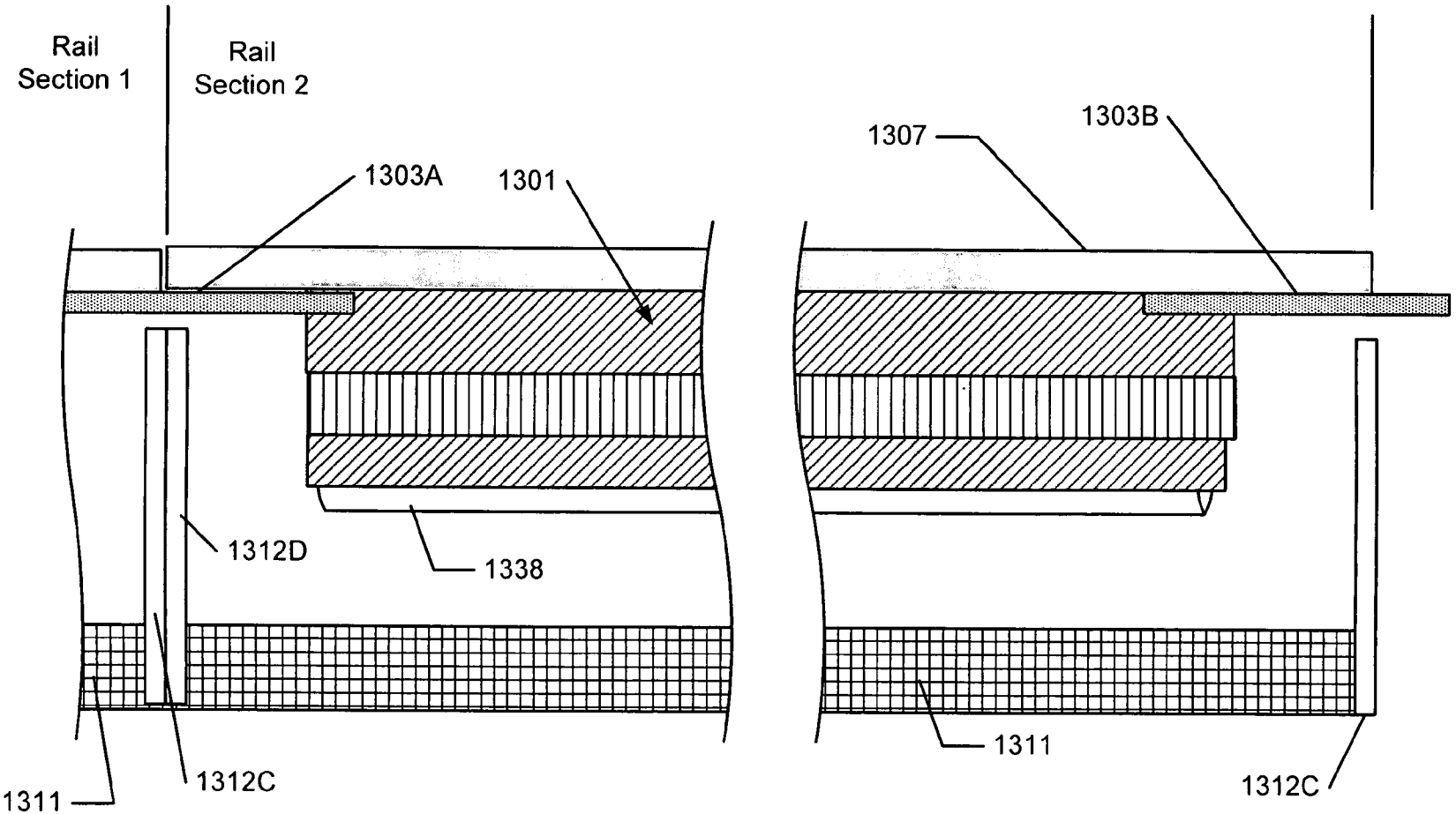
FIG. 13B illustrates a longitudinal cross-sectional view of two joined together frosted rail sections in accordance with some of the exemplary embodiments.

FIG. 13B illustrates a longitudinal cross-sectional view of two joined together rail sections in accordance with some of the exemplary embodiments. Rail section 1 is friction fit coupled to rail section 2 via the section connector tab 1303A for rail section 1. The section connector tab 1303A is slid, pieced, injected, cut into the thermal compound (first non-metallic layer) of the freezing and chilling mechanism 1301 during installation. The resiliency of the thermal compound allows the section connector tab 1303A to be adjusted so that leveling can take place between the top rail plates 1307 of adjacent rail sections 1 and 2. The re During installation, the end plate 1312C of rail section 1 is adjacent to end plate 1312D of rail section 2. The base pans 1311 of the rail sections 1 and 2 are configured to be affixed to a bar structure.

Figure 14:
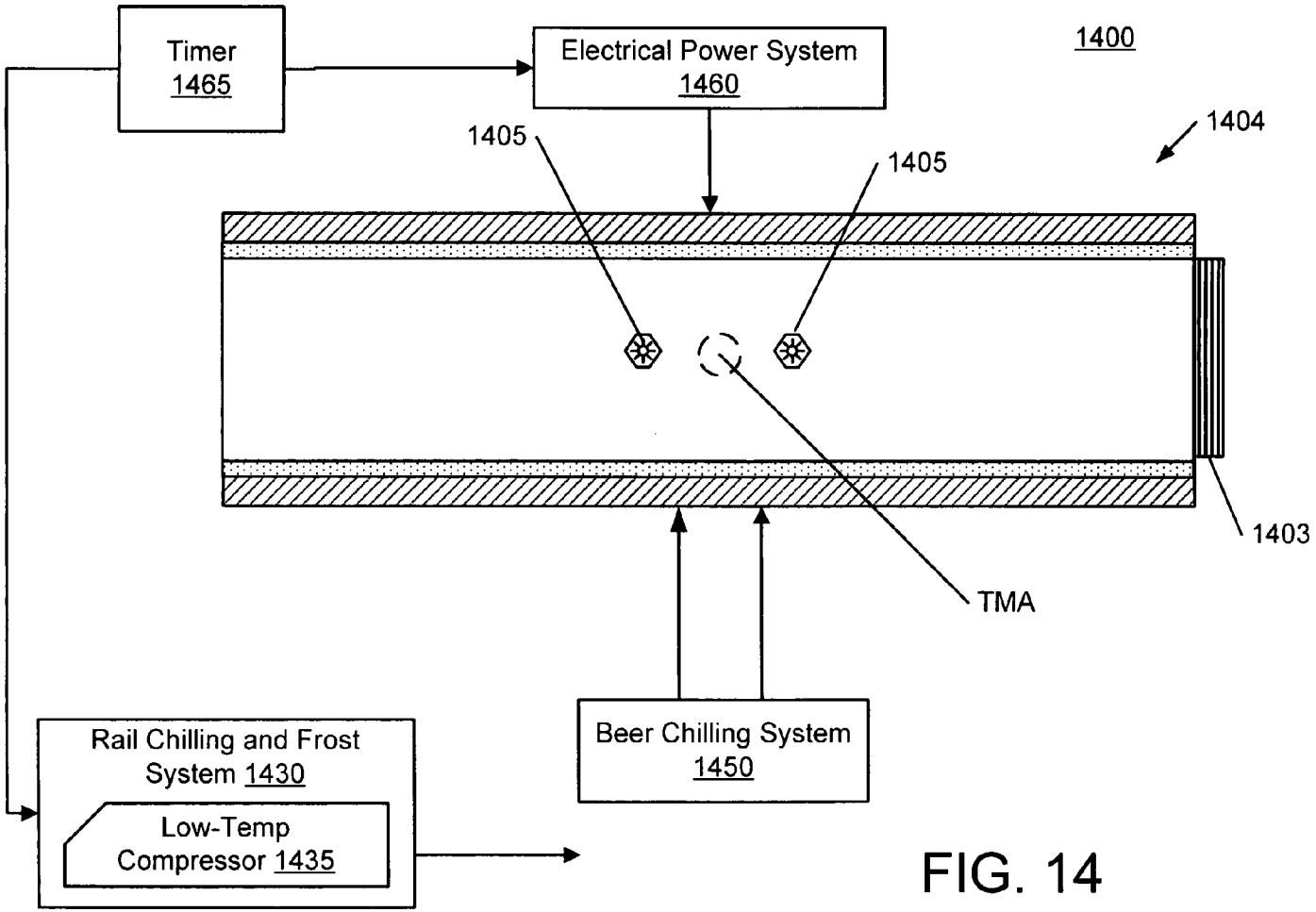
FIG. 14 illustrates a schematic view of a multi-configurable frosted bar rail system with a frosted beer tower rail section in accordance with some of the exemplary embodiments.

FIG. 14 illustrates a schematic view of a multi-configurable frosted bar rail system 1400 with a frosted beer tower rail section 1404 in accordance with some of the exemplary embodiments. The system 1400 includes a rail chilling and frost system 1430 with a low-temp compressor 1435. The rail chilling and frost system 1430 is coupled to a timer 1465 and electrical power system 1460. The rail section 1404 is coupled to a beer chilling system 1450 and has a tower mounting area TMA for mounting beer tower 220. Adjacent the tower mounting area TMA, the rail section 1404 includes lights 1405. The rail section 1404 includes a section connector tab 1403. Thus, the rail section 1404 supports a beer tower and lights. The lights are accents to illuminate the frost on the beer tower when created.

Figure 15:
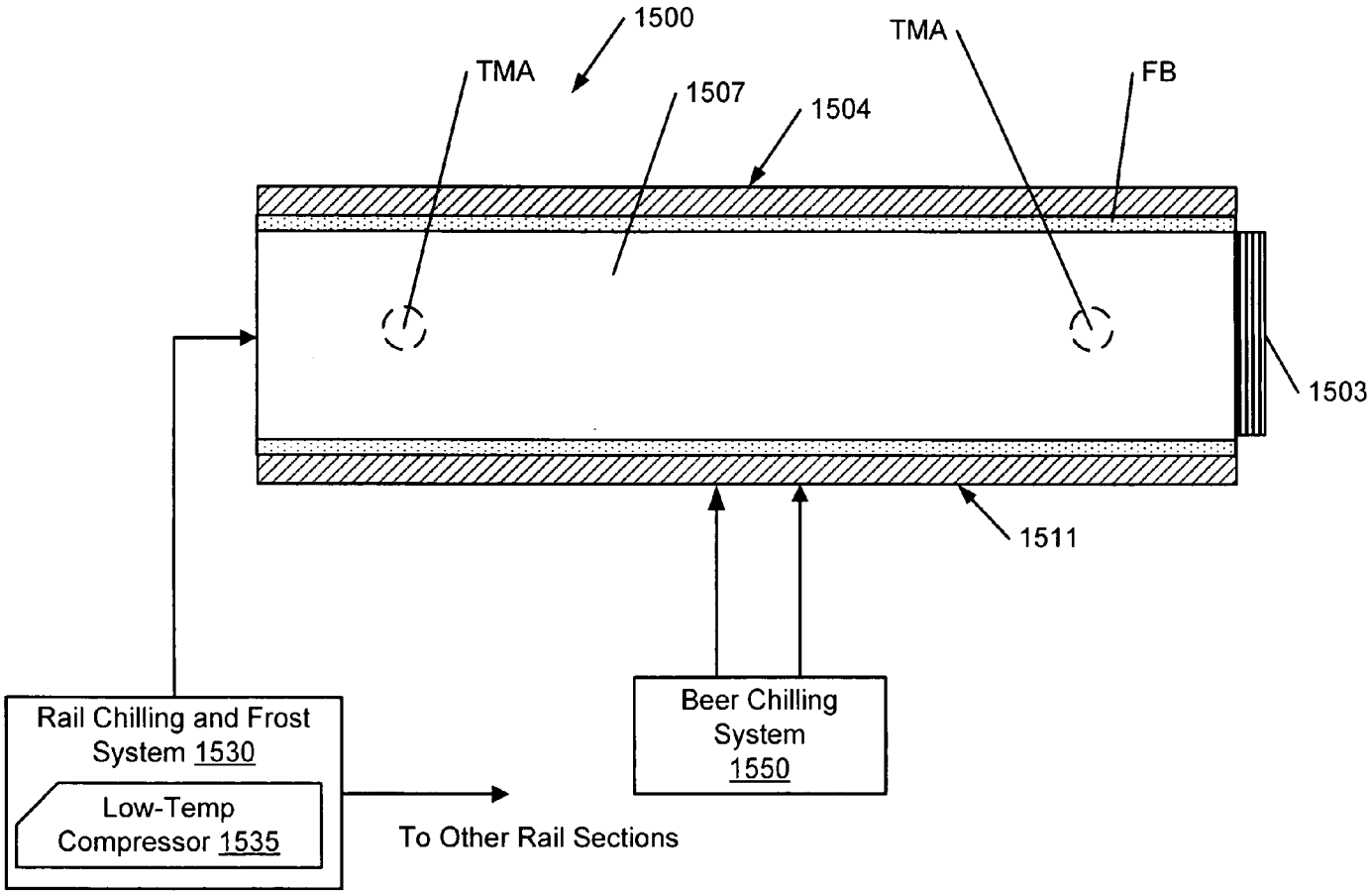
FIG. 15 illustrates a schematic view of a multi-configurable frosted bar rail system with a frosted beer tower rail section with multiple beer tower ports in accordance with some of the exemplary embodiments.

FIG. 15 illustrates a schematic view of a multi-configurable frosted bar rail system 1500 with a frosted beer tower rail section 1504 with multiple beer tower mounting areas TMA in accordance with some of the exemplary embodiments. The rail section 1504 is coupled to a beer chilling system 1550 and has two or more tower mounting areas TMA for mounting beer towers to the top rail plate 1507. The rail section 1504 does not include accent lights for the beer towers. The rail section 1504 includes a section connector tab 1503. A freeze break 1511 is shown between the top rail plate 1507 and the base pan 1511. However, the heater wire (FIG. 11) may be used instead.

Figure 16:
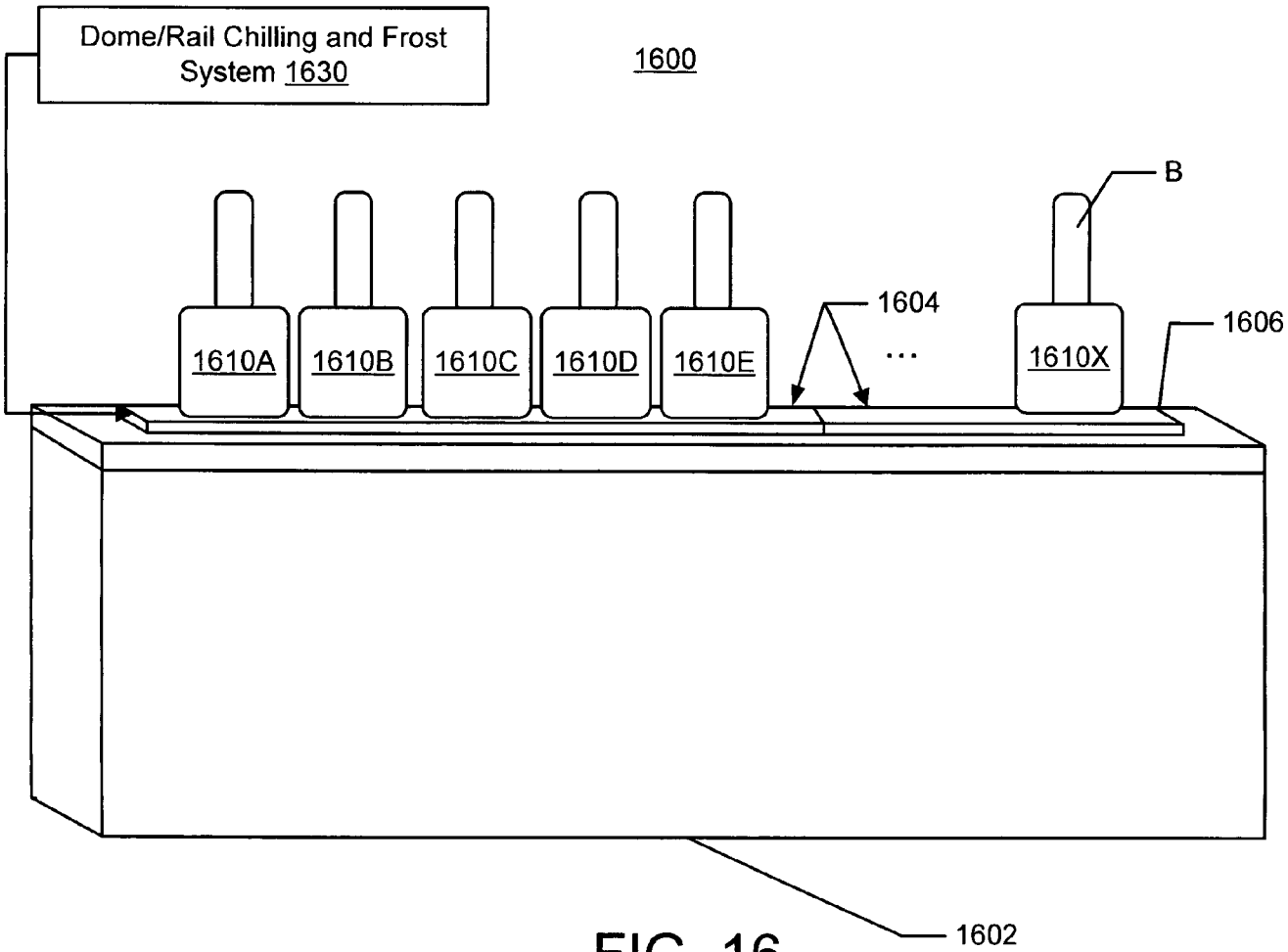
FIG. 16 illustrates a front view of a multi-configurable frosted bar rail system with one or more frosted beverage chilling and dispensing rail sections in accordance with some of the exemplary embodiments.

FIG. 16 illustrates a perspective view of a multi-configurable frosted bar rail system 1600 installed on a bar 1602 in accordance with some of the exemplary embodiments. The stationary bar 1602 may be any bar found in a restaurant, lounge, bar, billiard room, etc. The system 1600 includes one or more frosted beverage chilling and dispensing rail sections 1604. Each rail section 1604 includes a frosted dome mounting rail 1606 with one or more frosted beverage chilling and dispensing domes 1610A, 1610B, 1610C, 1610D, 1610E, . . . , 1610X configured to chill beverages within the dome. Each frosted beverage chilling and dispensing dome 1610A, 1610B, 1610C, 1610D, 1610E, . . . , 1610X is configured to create snowy white frosted ice or frost evenly about its perimeter. Likewise, the frosted dome mounting rail 1606 is configured to create snowy white frosted ice or frost evenly along its length.

Each frosted beverage chilling and dispensing dome 1610A, 1610B, 1610C, 1610D, 1610E, . . . , 1610X is configured to support a bottle B in an inverted position and dispense a beverage from the bottle B. In FIG. 16, the one or more frosted beverage chilling and dispensing domes 1610A, 1610B, 1610C, 1610D, 1610E, . . . , 1610X are shown on a side opposite that of the dispensing faucet (FIG. 2A).

The system 1600 includes a dome/rail chilling and frost system 1630 configured to deliver refrigerant to the frosted dome mounting rail 1606 and the one or more frosted beverage chilling and dispensing domes 1610A, 1610B, 1610C, 1610D, 1610E, . . . , 1610X. The one or more frosted beverage chilling and dispensing domes 1610A, 1610B, 1610C, 1610D, 1610E, . . . , 1610X are configured to chill liquor to a temperature within a predetermined range of cold temperatures and dispense the liquor from a vertically seated liquor bottle B. For example, the frosted beverage chilling and dispensing device 1604 is configured to chill in and dispense liquor from a dome 1610A, 1610B, 1610C, 1610D, 1610E, . . . , 1610X in the range of −5° to +5°.

In an exemplary embodiment, the frosted beverage chilling and dispensing device 1604 is a liquor beverage chiller and dispensing device that builds a layer of frost (snowy white frost) on an exterior perimeter surface of each dome 1610A, 1610B, 1610C, 1610D, 1610E, . . . , 1610X and chills an interior liner (FIGS. 6A-6B) of the dome to a temperature to chill the liquor or beverage stored therein. The liquor or beverage is stored in direct contact with the interior liner (FIG. 6).

In an exemplary embodiment, the frosted beverage chilling and dispensing domes 1610A, 1610B, 1610C, 1610D, 1610E, . . . , 1610X are configured to form white snowy like frost on the exterior perimeter surface thereof in ambient or room temperatures associated with a dining room, bar or main lounge environment. The exterior perimeter surface forms frosted ice evenly and continuously thereon such that there are no gaps, strips or other discontinuities of ice or frost formations.

As can be appreciated, the bar may be movable such that the bar structure includes wheels.

Figure 17:
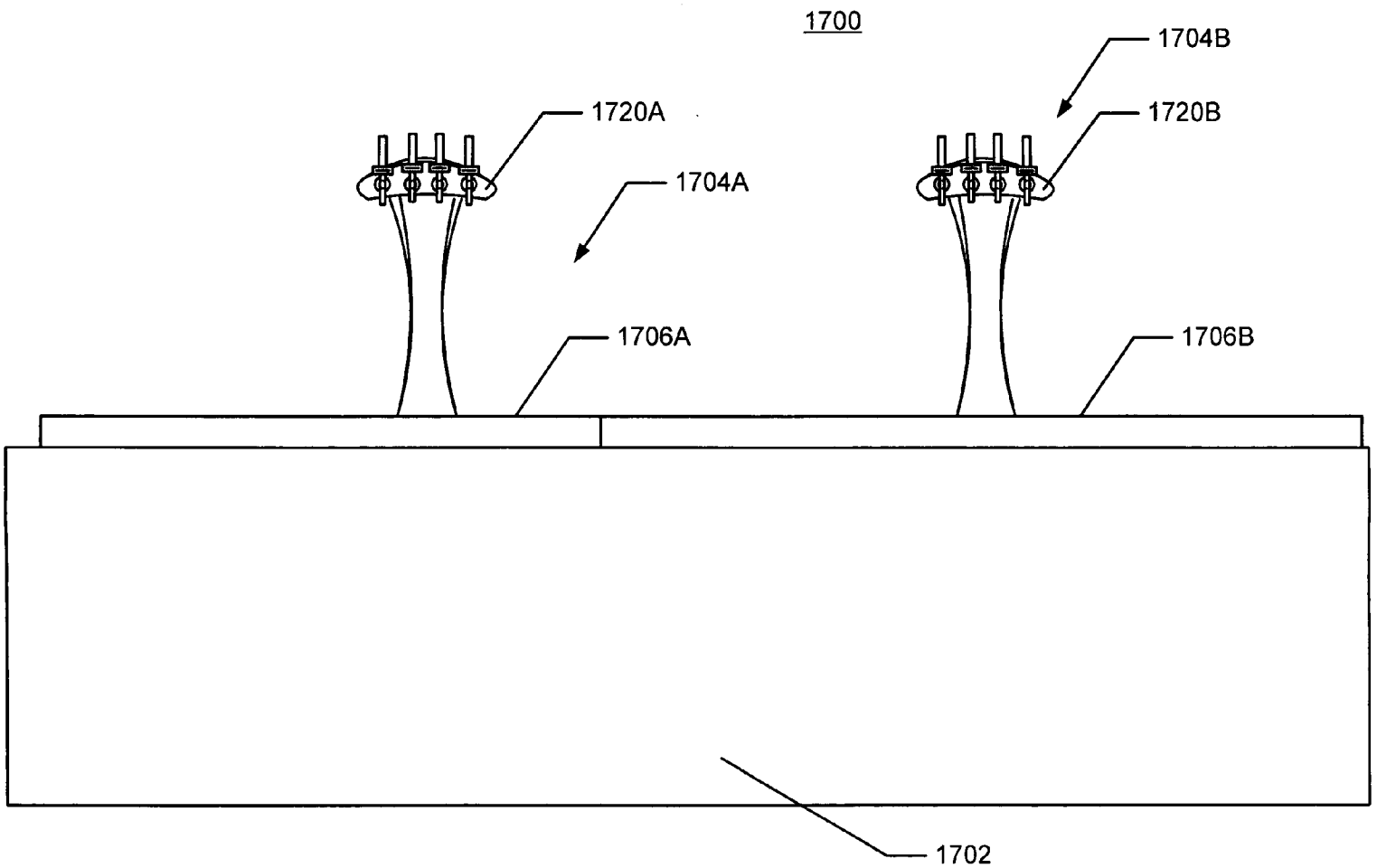
FIG. 17 illustrates a front view of a multi-configurable frosted bar rail system with one or more frosted bee tower rail sections in accordance with some of the exemplary embodiments.

FIG. 17 illustrates a front view of a multi-configurable frosted bar rail system 1700 with one or more frosted beer tower rail sections 1704A and 1704B in accordance with some of the exemplary embodiments. The system 1700 includes a plurality of rail sections 1704A and 1704B coupled to the bar structure 1702. In the exemplary embodiment, the rail sections 1704A and 1704B individually support only beer towers 1720A and 1720B, respectively, via rails 1706A and 1706B. The details of the rail sections 1704A and 1704B are described in relation to FIG. 3. The beer towers may be frosted or non-frosting beer towers.

The rails 1706A and 1706B form ice on the top rail plate as described in relation to FIG. 3.

As can be appreciated, the systems 1600 and 1700 may be combined such that an establishment may combine both systems 1600 and 1700 in a single room. Nonetheless, the rail sections of systems 1600 and 1700 may be varied with other rail section configurations described herein.

While the invention has been particularly shown and described with references to a preferred embodiment thereof, it will be understood by those skilled in the art that various changes in form and details may be made therein without departing from the spirit and scope of the invention.

What is claimed is:

1. A rail section comprising:

a base pan configured to catch and drain defrosting ice and fluids;

a top rail plate supported within the base pan; and a rail freezing and chilling mechanism coupled immediately under the top rail plate, the freezing and chilling mechanism being configured to create a, continuous layer of frost on top of the top rail plate from humidity of ambient air;

wherein the top rail plate is made of a metal having a first thermal conductivity factor; and the rail freezing and chilling mechanism includes:

a first non-metallic thermal layer immediately below the top rail plate;

a metal thermal conductor layer made of a metal with a second thermal conductivity factor greater than the first conductivity factor below the first non-metallic thermal layer;

a second non-metallic thermal layer below the metal thermal conductor layer; and at least one refrigerant line partially or fully embedded within the second non-metallic thermal layer, the at least one refrigerant line being configured to flow therethrough a refrigerant.

2. The rail section according to claim 1, further comprising: a plurality of domes mounted to the top rail plate; and a plurality of dome lights arranged around a base of each dome, the plurality of dome lights are configured to illuminate a layer of frost on the domes and the top rail plate.

3. The rail section according to claim 1, further comprising a beer dispensing tower coupled to said top rail plate.

4. The rail section according to claim 3, wherein the beer dispensing tower comprises a tower body wherein the tower body is configured to form a layer of frost on the tower body.

5. The rail section according to claim 1, further comprising a section connector tab coupled to a short side of the rail freezing and chilling mechanism, wherein the section connector tab is configured to be friction fit coupled to an adjacent rail section.

6. A rail section comprising:

a base pan configured to catch and drain defrosting ice and fluids;

a top rail plate supported within the base pan; and a rail freezing and chilling mechanism coupled immediately under the top rail plate, the freezing and chilling mechanism being configured to create a continuous layer of frost on top of the top rail plate from humidity of ambient air;

wherein the top rail plate has mounted thereto a dome for chilling and dispensing a beverage from a bottle, the dome comprising:

an external dome plate having a top opening;

an interior storage tank within the external dome plate; and a dome freezing and chilling mechanism between the external dome plate and the interior storage tank, the dome freezing and chilling mechanism being configured to receive a refrigerant to build a layer of frost on along the external dome plate from humidity of ambient air and the dome being configured to seat in the top opening the bottle in an inverted position and to chill and dispense the beverage from the interior storage tank;

wherein the external dome plate is made of a metal having a first thermal conductivity factor and the dome freezing and chilling mechanism comprises:

a first non-metallic thermal layer immediately concentric with the external dome plate;

a metal thermal conductor layer made of a metal with a second thermal conductivity factor greater than the first conductivity factor adjacent to and concentric with the first non-metallic thermal layer;

a second non-metallic thermal layer adjacent to and concentric with the metal thermal conductor layer; and at least one refrigerant line partially or fully embedded within the second non-metallic thermal layer, the at least one refrigerant line being configured to flow therethrough the refrigerant.

7. The rail section according to claim 6, further comprising: a plurality of domes mounted to the top rail plate; and a plurality of dome lights arranged around a base of each dome, the plurality of dome lights are configured to illuminate a layer of frost on the domes and the top rail plate.

8. The rail section according to claim 6, further comprising a beer dispensing tower coupled to said top rail plate.

9. The rail section according to claim 8, wherein the beer dispensing tower comprises a tower body wherein the tower body is configured to form a layer of frost on the tower body.

10. The rail section according to claim 6, further comprising a section connector tab coupled to a short side of the rail freezing and chilling mechanism, wherein the section connector tab is configured to be friction fit coupled to an adjacent rail section.

11. A rail section comprising:

a base pan configured to catch and drain defrosting ice and fluids;

a top rail plate supported within the base pan;

a rail freezing and chilling mechanism coupled immediately under the top rail plate, the freezing and chilling mechanism being configured to create a continuous layer of frost on top of the top rail plate from humidity of ambient air;

first and second elongated heating wires enclosed along longitudinal sides of the top rail plate; and a temperature control unit configured to control heat along each of the elongated heating wires to minimize condensation;

wherein the top rail plate is made of a metal having a first thermal conductivity factor; and the rail freezing and chilling mechanism includes:

a first non-metallic thermal layer immediately below the top rail plate;

a metal thermal conductor layer made of a metal with a second thermal conductivity factor greater than the first conductivity factor below the first non-metallic thermal layer;

a second non-metallic thermal layer below the metal thermal conductor layer; and at least one refrigerant line partially or fully embedded within the second non-metallic thermal layer, the at least one refrigerant line being configured to flow therethrough the refrigerant.

12. The rail section according to claim 11, further comprising: a plurality of domes mounted to the top rail plate; and a plurality of dome lights arranged around a base of each dome, the plurality of dome lights are configured to illuminate a layer of frost on the domes and the top rail plate.

13. The rail section according to claim 11, further comprising a beer dispensing tower coupled to said top rail plate.

14. The rail section according to claim 13, wherein the beer dispensing tower comprises a tower body wherein the tower body is configured to form a layer of frost on the tower body.

15. The rail section according to claim 11, further comprising a section connector tab coupled to a short side of the rail freezing and chilling mechanism, wherein the section connector tab is configured to be friction fit coupled to an adjacent rail section.

16. A rail section comprising:

a base pan configured to catch and drain defrosting ice and fluids;

a top rail plate supported within the base pan;

a rail freezing and chilling mechanism coupled immediately under the top rail plate, the freezing and chilling mechanism being configured to create a continuous layer of frost on top of the top rail plate from humidity of ambient air;

first and second elongated heating wires enclosed along longitudinal sides of the top rail plate; and a temperature control unit configured to control heat along each of the elongated heating wires to minimize condensation;

wherein the top rail plate has mounted thereto a dome for chilling and dispensing a beverage from a bottle, the dome comprising:

an external dome plate having a top opening;

an interior storage tank within the external dome plate; and a dome freezing and chilling mechanism between the external dome plate and the interior storage tank, the dome freezing and chilling mechanism being configured to receive a refrigerant to build a layer of frost along the external dome plate from humidity of ambient air and the dome being configured to seat in the top opening the bottle in an inverted position and to chill and dispense the beverage from the interior storage tank;

wherein the external dome plate is made of a metal having a first thermal conductivity factor and the dome freezing and chilling mechanism comprises:

a first non-metallic thermal layer immediately concentric with the external dome plate;

a metal thermal conductor layer made of a metal with a second thermal conductivity factor greater than the first conductivity factor adjacent to and concentric with the first non-metallic thermal layer;

a second non-metallic thermal layer adjacent to and concentric with the metal thermal conductor layer; and at least one refrigerant line partially or fully embedded within the second non-metallic thermal layer, the at least one refrigerant line being configured to flow therethrough the refrigerant.

17. The rail section according to claim 16, further comprising: a plurality of domes mounted to the top rail plate; and a plurality of dome lights arranged around a base of each dome, the plurality of dome lights are configured to illuminate a layer of frost on the domes and the top rail plate.

18. The rail section according to claim 16, further comprising a beer dispensing tower coupled to said top rail plate.

19. The rail section according to claim 18, wherein the beer dispensing tower comprises a tower body wherein the tower body is configured to form a layer of frost on the tower body.

20. The rail section according to claim 16, further comprising a section connector tab coupled to a short side of the rail freezing and chilling mechanism, wherein the section connector tab is configured to be friction fit coupled to an adjacent rail section.

* * * * *